US006123404A

United States Patent [19]

Tanaka et al.

[11] Patent Number: 6,123,404

[45] **Date of Patent: *Sep. 26, 2000**

[54] RECORDING APPARATUS FOR COUNTING IMAGE RECORDING DRIVE DATA

[75] Inventors: Hideki Tanaka, Yokohama; Shinji Takagi, Kawasaki; Hiroyuki Hyotani, Tokyo; Takehiko Kasamatsu, Fujisawa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/550,783

[22] Filed: Oct. 31, 1995

[30] Foreign Application Priority Data

| | | | |
|---|---|---|---|
| Oct. 31, 1994 | [JP] | Japan | 6-267362 |
| May 30, 1995 | [JP] | Japan | 7-131835 |
| Aug. 31, 1995 | [JP] | Japan | 7-223586 |

[51] Int. Cl.[7] ..... B41J 29/38

[52] U.S. Cl. ..... 347/5; 347/7; 347/9; 347/23; 358/1.15; 358/449

[58] Field of Search ..... 347/9, 12, 13, 347/14, 7, 23, 5, 3; 358/1.15, 449, 442

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo, et al. . | |
| 4,740,796 | 4/1988 | Endo et al. . | |
| 4,791,435 | 12/1988 | Smith et al. . | |
| 4,910,528 | 3/1990 | Firl et al. . | |
| 5,068,806 | 11/1991 | Gatten | 395/113 |
| 5,245,362 | 9/1993 | Iwata et al. | 347/23 |
| 5,353,051 | 10/1994 | Katayama et al | 347/13 |
| 5,357,268 | 10/1994 | Kishida et al. | 347/13 |
| 5,500,661 | 3/1996 | Matsubara et al. | 347/41 |

FOREIGN PATENT DOCUMENTS

| | | | |
|---|---|---|---|
| 0440500 | 8/1991 | European Pat. Off. . | |
| 0443808 | 8/1991 | European Pat. Off. . | |
| 0589581 | 3/1994 | European Pat. Off. . | |
| 0593282 | 4/1994 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 62-92850 | 4/1987 | Japan | 347/7 |
| 62-290556 | 12/1987 | Japan . | |
| 2-141249 | 5/1990 | Japan . | |
| 3-58854 | 3/1991 | Japan . | |
| 3031352 | 5/1991 | Japan . | |
| 3-208656 | 9/1991 | Japan . | |
| 3-211061 | 9/1991 | Japan . | |
| 519467 | 3/1993 | Japan . | |

OTHER PUBLICATIONS

English translation of Japanese Laid–Open Patent Application No. 62–92850.

English translation of Japanese Laid–Open Patent Application No. 62–290556.

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recording head is provided with a plurality of recording elements. In the recording head, the number of record data can be counted accurately, following high-speed recording operation by counting only the number of drive data input via one signal line by means of a counter, from drive data input to two shift registers via signal lines according to a clock signal.

84 Claims, 18 Drawing Sheets

RECORDING APPARATUS FOR COUNTING IMAGE RECORDING DRIVE DATA

BACKGROUND OF THE INVENTION

1. Field of the Invention

The invention relates to a recording apparatus, particularly to a recording apparatus for recording according to ink jet printing, and further to an ink jet recording apparatus provided with a data count means for counting drive data.

2. Related Background Art

In the conventional recording apparatus according to ink jet printing, counting the number of drive data on emission of ink from a recording head is a technique required for preventing a nozzle (outlet) of a recording head from being blocked. Determining the time of recovery by absorption performed for removing foams generated in a recording head, controlling a rise of temperature in a recording head and detecting the residual quantity of ink in an ink reservoir for supplying ink to a recording head may also be used. For example, the technique for counting the number of drive data on emission from a recording head, controlling temperature and controlling discharge is disclosed in U.S. Pat. Nos. 4,791,435 and 4,910,528. Japanese Patent Publication No. 5-19467(1993) discloses that residual quantity of ink in an ink reservoir can be detected by counting the number of drive data on emission of ink from a recording head.

Recently, for example, the number of ink nozzles of a recording head is increased from 64 to 128 and the frequency of emission of ink is also increased from 5 kHz to 10 kHz. Further, the recording density of a recording head is also increased from 300 dot per inch (dpi) to high resolution such as 600 dpi.

In the meantime, a technique of so-called multidroplet in which the discharge of ink per recording operation is decreased and a plurality of ink droplets are emitted for one pixel to form an image, is being realized in such a high definition recording head. To realize this technique, a mode for data transfer from a recording apparatus to a recording head is required to be changed from serial transfer to parallel transfer, so as to increase the number of drive data regarding emission of ink from a recording head which must be counted in a fixed time and maintain the speed of recording operation at a high speed is also used. Further, to count the number of drive data on emission of ink from a recording head on such a condition, high-speed counting operation with precision in counting maintained to some extent is required.

A method in which precision in counting the number of drive data on emission of ink from a recording head is disclosed in Japanese Patent Publication No. 3-31352 (1991). However, this method cannot be used particularly for controlling or estimating temperature in a recording head.

To change a mode for data transfer to a recording head from serial transfer to parallel transfer and to count entire drive data in data lines for parallel transfer at a high speed a counter must be provided for each of the data lines and data in the counters must be added at a high speed. As a result, a problem that the constitution of the circuits is of large size occurs.

In the present circuitry technology, in case counting speed is not taken into consideration, the number of data can be counted by mounting multiple counters. However, to take the above-described frequency of emission of ink into consideration and add data on emission of ink from a plurality of nozzles of a recording head at a high speed, special circuitry is required. As a result, a problem that it increases the cost of the system occurs.

Further, when a color ink jet recording apparatus developing in the market at present (wherein four recording heads are mounted) is taken into consideration in addition to the conventional monochrome ink jet recording apparatus, the requirement for high speed is more severe and a problem that the constitution of the circuitry is of large size is more serious.

SUMMARY OF THE INVENTION

The object of the invention is to provide a recording apparatus/method having simple constitution of circuitry wherein the number of drive data on emission of ink from a recording head can be counted at a high speed.

Another object of the invention is to provide a recording apparatus/method wherein the number of drive data can be counted to satisfy control requirements of precision for estimating the temperature of a recording head, for timing of the suction recovery of the recording head, and for detection of the residual quantity of ink.

In order to achieve the above-mentioned objects, there is provided recording apparatus for recording on a recording medium using a recording head provided with a plurality of recording elements, comprising: input means for inputting recording data; transfer means for transferring to the recording head drive data based upon the recording data input by the input means; drive means for driving the recording head according to the drive data transferred by the transfer means; and count means for counting a part of the drive data transferred by the transfer means.

Also, there is provided a recording method for recording on a recording medium using the recording head provided with a plurality of recording elements, comprising the steps of: inputting recording data; transferring to the recording head drive data based upon the recording data input in the input step; driving the recording head according to the drive data transferred in the transfer step; and counting a part of the drive data transferred in the transfer step.

Also, there is provided a recording apparatus for recording on a recording medium using a recording head provided with a plurality of recording elements, comprising: input means for inputting recording data; drive means for driving the recording head according to drive data based upon the recording data input by the input means; transfer means for transferring drive data allocated to the plurality of recording elements to the recording head via the same signal line in synchronization with a transfer clock; count means for counting the drive data transferred by the transfer means, wherein the count means comprises a plurality of counters and selecting means for selecting any of the plurality of counters in response to the transfer clock, and wherein the any of counters selected by the selecting means counts the drive data allocated to the plurality of recording elements.

Also, there is provided a recording method for recording on a recording medium using a recording head provided with a plurality of recording elements, comprising the steps of: inputting recording data; driving the recording head according to drive data based upon the recording data input in the input step; transferring drive data allocated to the plurality of recording elements to the recording head via the same signal line in synchronization with a transfer clock; and counting drive data transferred in the transfer step, wherein in the count step, any of a plurality of counters is selected in response to the transfer clock, and the selected counter counts the drive data allocated to the plurality of recording elements.

Also, there is provided a recording apparatus for recording on a recording medium using a recording head provided with a plurality of recording elements, comprising scanning means for reciprocatingly scanning the recording head for recording; input means for inputting recording data; transfer means for transferring to the recording head drive data based upon the recording data input by the input means; drive means for driving the recording head according to the drive data transferred by the transfer means; and count means for counting the drive data transferred by the transfer means, in the forward and backward scans of the recording head.

Also, there is provided a recording method for recording on a recording medium using a recording head provided with a plurality of recording elements, comprising the steps of: scanning reciprocatingly the recording head for recording; inputting recording data; transferring to the recording head drive data based upon the recording data input in the input step; driving the recording head according to the drive data transferred in the transfer step; and counting the drive data transferred in the transfer step in the forward and backward scans of the recording head.

According to one aspect of the invention provided with the above-described constitution, a part of record data for causing emission of ink from a recording head is counted.

According to one aspect of the invention, high-speed counting with precision to some extent is also enabled and a load on hardware can be also decreased.

According to a further aspect of the invention, record data for causing emission of ink from a first recording head provided with a plurality of nozzles is counted in forward and backward scans during reciprocating scanning by the first recording head.

In detail, in the forward scan, record data for causing emission of ink from a half of a plurality of nozzles of the first recording head is counted, while in the backward scan, record data for causing emission of ink from the residual half of the nozzles is counted. The above-described half of the nozzles are even or odd nozzles.

DESCRIPTION OF THE PREFERRED EMBODIMENTS

Referring to the attached drawings, preferred embodiments according to the invention will be described in detail below.

Figure 1:
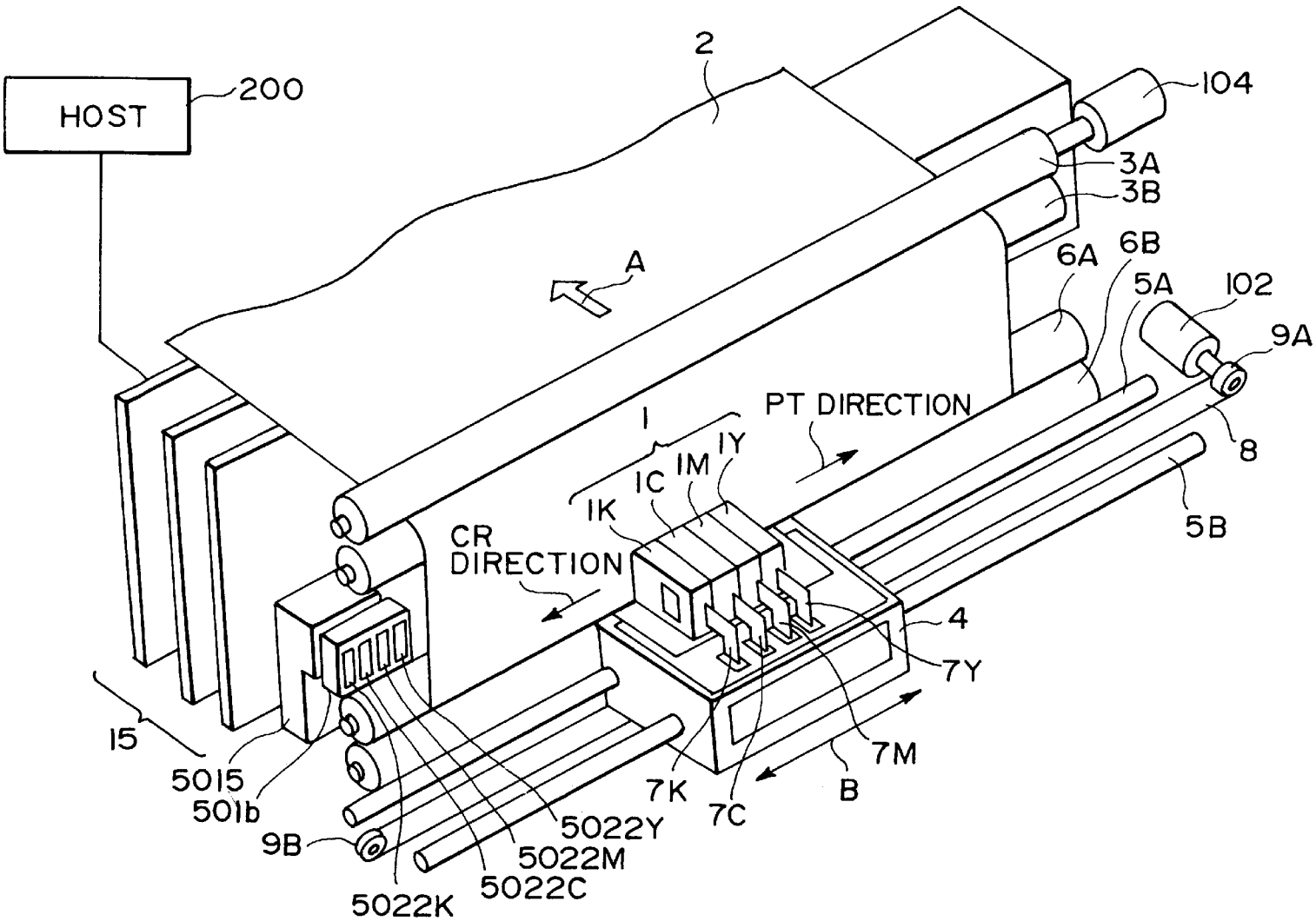
FIG. 1 is a perspective view showing the schematic constitution of an ink jet recording apparatus according to a typical embodiment of the invention.

FIG. 1 is a schematic perspective view showing the main part of an ink jet recording apparatus according to a typical embodiment of the invention. As shown in FIG. 1, for example, 256 nozzles (outlets) arranged in two lines apart from each other by 1/300 inch in a feeding direction of a recording paper 2 (hereinafter called a sub-scanning direction) are provided for each of recording heads 1Y, 1M, 1C and 1K for emitting ink of Y (yellow), M (magenta), C (cyan) and K (black), respectively. A heater for generating thermal energy used for emission of ink is provided to an ink passage communicating with each nozzle. The heater generates heat according to an electric pulse applied according to drive data so as to generate film boiling in ink, and as a result of generation of bubbles due to the film boiling, ink droplets are emitted from a nozzle. In this embodiment, the heater driving frequency, that is, the frequency of emission of ink is set to 10 kHz. A reference number 1 designates a general term of a recording head used when the whole of the recording heads 1Y, 1M, 1C and 1K is referred to.

A carriage 4 mounts a recording head 1, and moves in the direction shown by an arrow B (hereinafter called a main scanning direction) under guidance by two guide shafts 5A and 5B slidably engaged a part of the carriage. The carriage 4 is moved by conveying a wire 8 attached to a part of the carriage 4 and stretched between pulleys 9A and 9B by rotation of a motor 102 via the pulley 9A.

Ink supplied to each of the recording heads 1Y, 1M, 1C and 1K is stored in an ink cartridge (not shown) for each color provided in the carriage 4. The ink is supplied to each of the recording heads 1Y, 1M, 1C and 1K through an ink supply passage (not shown). Flexible cables 7C, 7M, 7Y and 7K are connected to the recording heads 1Y, 1M, 1C and 1K respectively. A driving signal and a control signal based upon record data can be sent from a control board 15 to a driving circuit (a head driver) for each of the recording heads via the cable.

Paper feed rollers 3A and 3B are provided so that the longitudinal direction may be parallel to the guide shafts 5A and 5B, and are rotated according to a drive of a paper feed motor 104 so as to carry a recording paper 2 as a recording medium. Similar paper feed rollers 6A and 6B are provided below the paper feed rollers 3A and 3B. They are rotated according to feeding of the recording paper 2 to smooth a recording face of the recording paper 2 by cooperating with the paper feed rollers 3A and 3B.

A reference number 501*b* designates a member for supporting cap members 5022Y, 5022M, 5022C and 5022K for capping the front face of the recording heads 1Y, 1M, 1C and 1K, and a reference number 5015 designates a suction unit for conducting suction for these cap members to record the recording heads 1Y, 1M, 1C and 1K through openings of the cap members.

In the constitution described above, the recording heads 1Y, 1M, 1C and 1K respectively emit ink on a recording face of the recording paper 2 (that is, a part opposite to ink nozzles of the recording head 1) to record as the carriage 4 moves. When the recording head 1 is moved in the direction shown by "PT" recording is performed, while when the recording head 1 is moved in the direction shown by "CR", the recording paper 2 is carried in the sub-scanning direction.

The present ink jet recording apparatus receives record data from a host 200 for recording.

Figure 2:
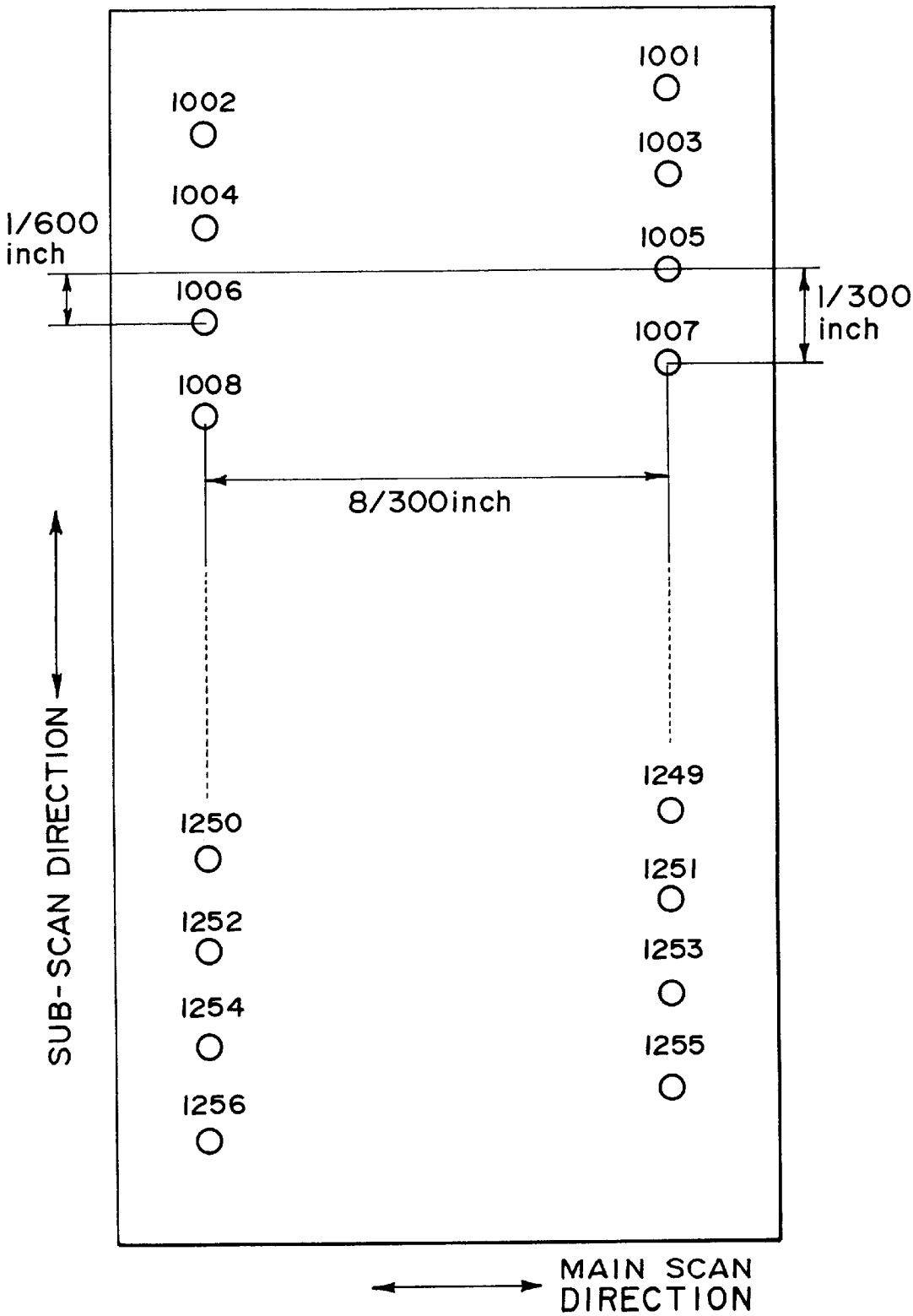
FIG. 2 shows an arrangement of nozzles of a recording head of the ink jet recording apparatus shown in FIG. 1.

FIG. 2 is a view, taken from the ink emission direction, showing one of the recording heads 1Y, 1M, 1C and 1K in the ink jet recording apparatus shown in FIG. 1. In FIG. 2, reference numbers 1001 to 1256 designate ink nozzles (outlets) respectively, and the ink nozzles are constituted by two lines of nozzles denoted by odd and even ones of these reference numbers (hereinafter called nozzle numbers). It is noted that the reference numbers are not always equivalent to the order of emission. The lines are apart from each other by 8/300 inch. The ink nozzles on each line are apart from each other by 1/300 inch, and the ink nozzles on both lines are arranged in a zigzag form in the order of the nozzle numbers. That is, the resolution of the recording head is 1/600 inch in the sub-scanning direction.

Figure 3:
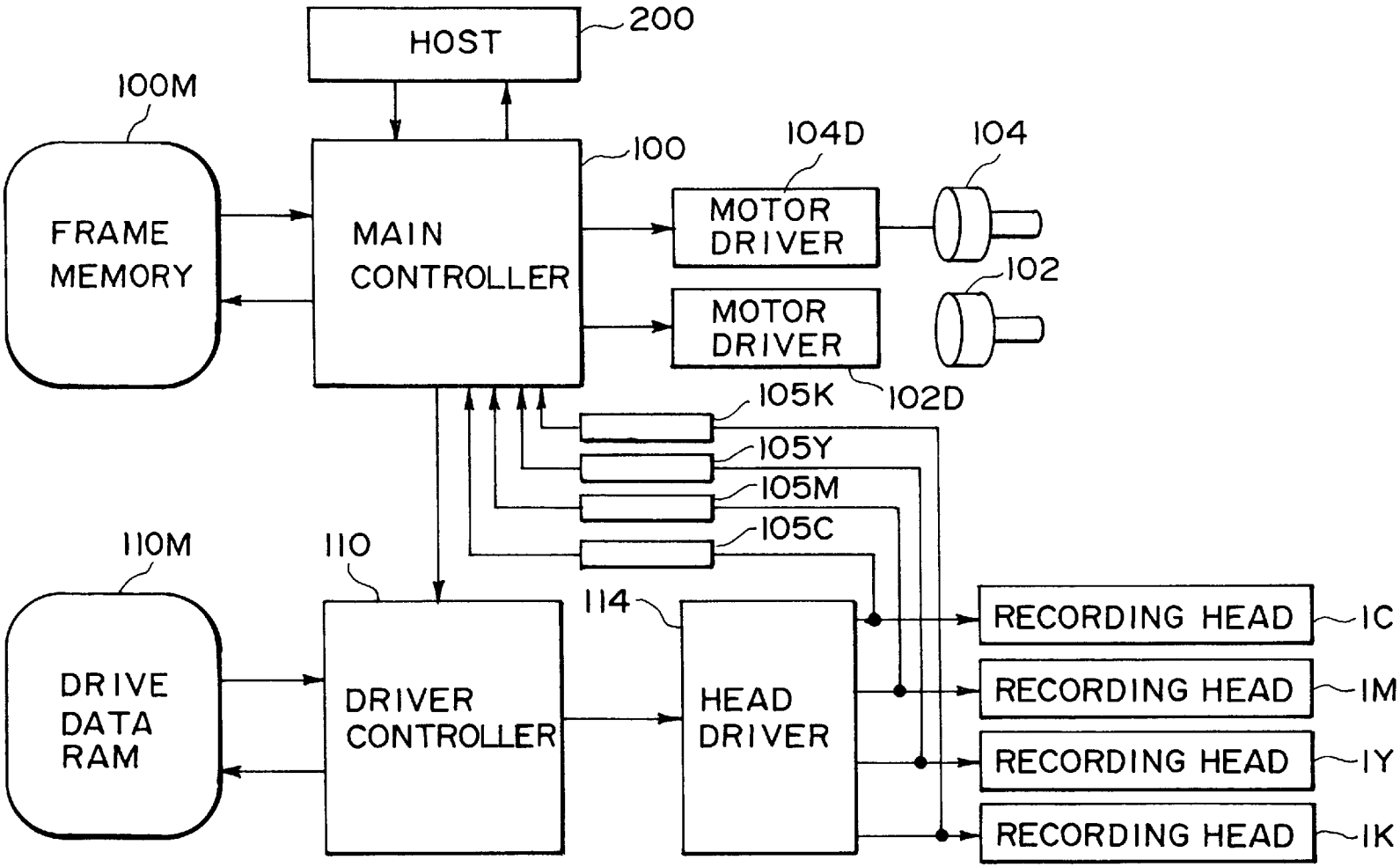
FIG. 3 is a block diagram showing the constitution of a control board 15 of the ink jet recording apparatus shown in FIG. 1.

FIG. 3 is a block diagram showing the constitution of the control board 15 of the ink jet recording apparatus as shown in FIG. 1.

A main controller 100 comprises a CPU, a RAM and a ROM, etc., receives a character code and image data sent from a host 200 and temporarily stores them in a frame memory 100M. The main controller 100 converts the character code and the image data stored in the frame memory 100M to recording signals for respective color components, and in response to each scanning of the recording head stores them as drive data of the recording head in a drive data RAM 110M via a driver controller 110. The driver controller 110 reads the drive data stored in the drive data RAM 110M, referring to a nozzle number and a scan number (a scan number in the sub-scanning direction from a starting point of recording operation), according to a control signal from the main controller 100, and supplies the read data to a head driver 114 to control drive timing. A part of data signal lines (described in detail later) connected between the head driver 114 and the recording heads 1Y, 1M, 1C and 1K is input to counters 105Y, 105M, 105C and 105K to count the number of data as supplied to the recording heads and subjected to a recording operation. In this embodiment, the head driver 114 and counters 105 are provided in the body of the recording apparatus.

The count value is fed back to the main controller 100 and is used for control for suction recovery, as an estimate of the residual quantity of ink, and as the estimate of the temperature in the recording head.

Therefore the higher the precision in counting of the above-described count value is, the more accurate the timing of the suction recovery is, the more accurate the estimated residual quantity of ink is, and the more accurate the estimated temperature in the recording head is. Thus, the drive of the recording head can be controlled appropriately according to the estimated temperature.

In the constitution described above, the main controller 100 controls the recording operation of the recording head via the driver controller 110, a motor driver 104D and a motor driver 102D. As a result, a character of an image according to image data is recorded on the recording paper 2.

First Embodiment

Next, a first embodiment of the present invention applied to the ink jet recording apparatus described above will be described. The constitution of the recording heads 1Y, 1M, 1C and 1K is common except the ink to be used. Therefore, only a recording head using one color of ink will be described below.

Figure 4:
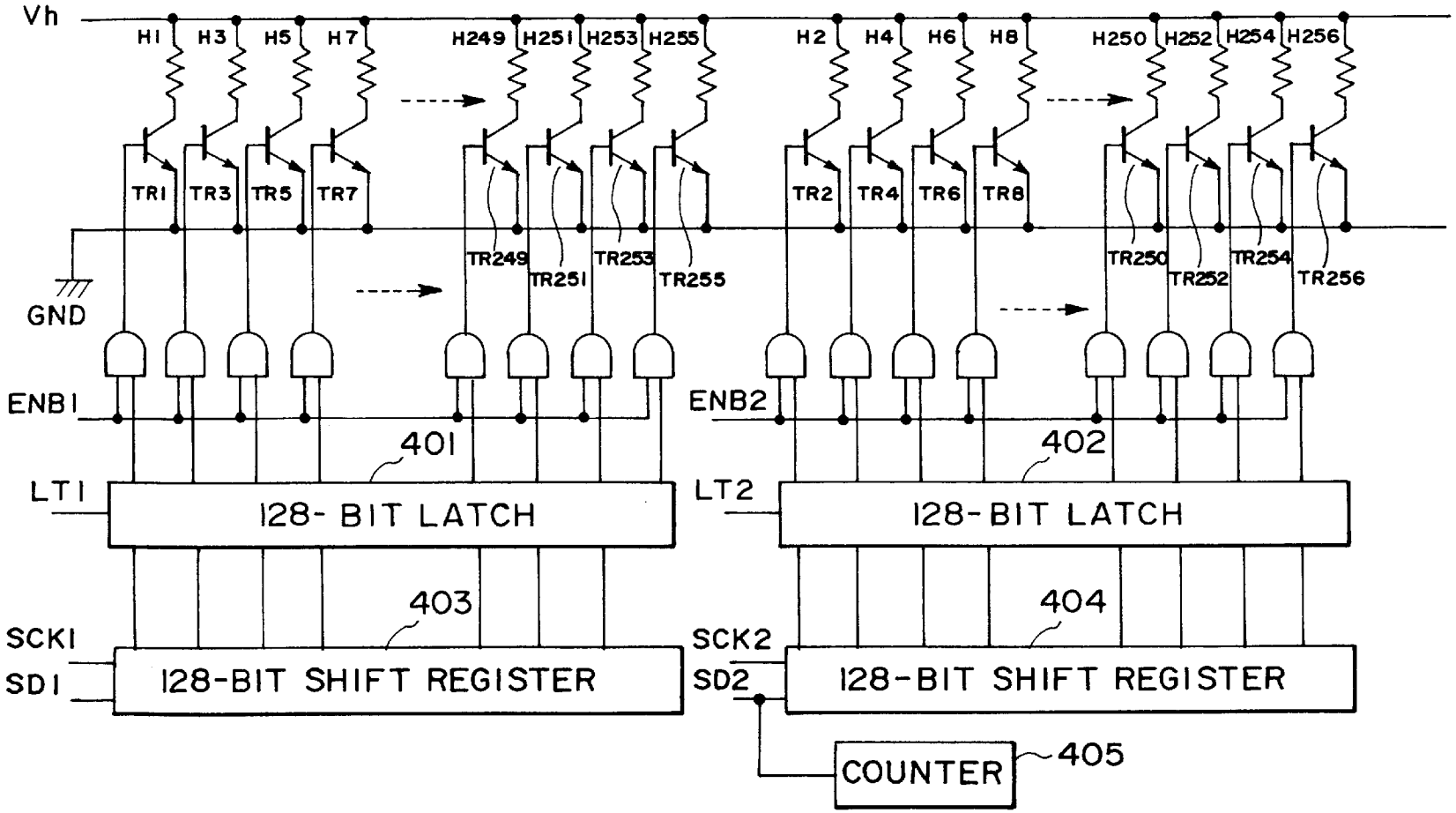
FIG. 4 shows the constitution of logic circuitry according to a first embodiment.

FIG. 4 shows the circuit constitution of the recording head as shown in FIG. 2, for heating nozzles according to drive data transferred from the recording apparatus to emit ink from each nozzle of the recording head. This circuit can count the frequency of emission of ink related to each nozzle of the recording head.

Referring to FIG. 4, H1 to H256 are heaters corresponding to the nozzles 1001 to 1256 shown in FIG. 2, for generating thermal energy, TR1 to TR256 are transistors corresponding to heaters H1 to H256 for driving respective heaters. Reference numbers 401 and 402 designate 128-bit latch circuits which latch drive data of respective heaters by latch signals LT1, LT2. Reference numbers 403 and 404 designate 128-bit shift resisters which receive drive data to be supplied to respective heaters in synchronization with clock signals SCK1 and SCK2 via signal lines SD1 and SD2, respectively. A reference number 405 designates a counter corresponding to the counter units 105 shown in FIG. 3, for counting data on emission.

The counter 405 exists outside the recording head and is similar to the counters 105Y, 105M, 105C and 105K on the control board 15 of the recording apparatus shown in FIG. 3.

Data for each heater transferred via the signal lines SD1 and SD2 is input to the circuit of the recording head shown in FIG. 4 in synchronization with the clock signals SCK1 and SCK2 respectively, according to operation of the carriage 4. That is, 128-bit data is serially transferred for the heaters H1, H3, . . . H255 with odd numbers according to the clock signal SCK1 and 128-bit data is serially transferred to the heaters H2, H4, . . . H256 with even numbers according to the clock signal SCK2. At this time, the counter 405 counts data transferred serially to the signal line SD2. Next, when 128-bit data is transferred to the respective shift resisters 403 and 404 and supply of the clock signals SCK1 and SCK2 is suspended, the latch signals LT1 and LT2 are output to the recording head to latch data transferred so far by the 128-bit latch circuits 401 and 402. As a result, the data corresponding to each heater is held in the 128-bit latch circuits 401 and 402. At this time, the counter 405 is in a ready state for the next counting operation, since the count value in the counter 405 has been cleared after being supplied to the main controller 100.

Next, when strobe signals ENB1 and ENB2 are output to the recording head, a signal corresponding to data stored in the 128-bit latch circuits 401 and 402 is supplied to each of the transistors Tr1 to Tr256. Each heater is heated according to the data and ink is emitted from each nozzle. At the same time when strobe signals ENB1 and ENB2 are supplied and ink is emitted, data on the next operation for emission of ink is transferred to the 128-bit shift registers 403 and 404 respectively in synchronization with the clock signals SCK1 and SCK2 respectively. By repeating a procedure for operation for emission of ink similarly, images are formed on the recording paper. In an example shown in FIG. 4, only one signal line is prepared for each of the strobe signals ENB1 and ENB2 so, in this example, the heaters with odd numbers H1, H3, . . . , H255 and the heaters with even numbers H2, H4, . . . , H256 are heated simultaneously. However, the circuitry of the recording head may be constituted so that a plurality of signal lines are provided as the strobe signal, and as a result, timing of emission of ink from each heater can be changed. That is, various types of driving methods such as time sharing driving and distributed driving can be applied.

The counter 405 is connected to only the signal line SD2, and in this embodiment, only data on ink nozzles corresponding to the heaters with even numbers H2, H4, . . . , H256 is counted. That is, only data on a half of the entire nozzles of the recording head is counted. As a result, the maximum count of the counter 405 may be a half of the number of the entire nozzles.

Next, recording density in which a recording head can record and resolution of an image formed according to data sent from the host 200 will be described below.

As shown in FIG. 2, the recording head according to this embodiment can record in recording density of 600 dpi in the sub-scanning direction, while most of applications running in the host for generating a character and image data generate data with resolution of 300 dpi. Therefore, in the case of a recording head with resolution of 600 dpi, the same data is given as two adjacent dots. Therefore, in the recording head according to this embodiment, if only data on ink nozzles corresponding to the heaters with even numbers H2, H4, . . . , H256 as described above is counted, the double the number of it can be regarded as the count for the entire nozzles.

Even if image data of 600 dpi is recorded by smoothing character data using high-density recording faculty (such as 600 dpi) as the recording head of this embodiment, an error of the count is trifling and gives no effect on the various processing to be executed according to the count.

In case a high definition image is output by applying pseudo intermediate processing to image data, randomness in used nozzles of the recording head is also sufficiently held and there is no problem in count precision. Further, in case recording is performed using a recording head as in this embodiment, a technique called multi-pass, that is, a method for forming pixels of one line in the main scanning direction by a plurality of nozzles arranged in the sub-scanning direction is often used. In such a case, even if only the nozzles with even numbers as in the first embodiment are counted, there is no problem because each data is delivered to every nozzle.

Therefore, according to this embodiment, as it is not required to count the number of heater driving data over all the nozzles of the recording head, a small amount of data may be counted, and a small number of counters such as one counter may be prepared. Also, adding process between counters is not required. As a result, the present invention is applicable to a recording operation to be executed at a high speed.

Second Embodiment

Figure 5:
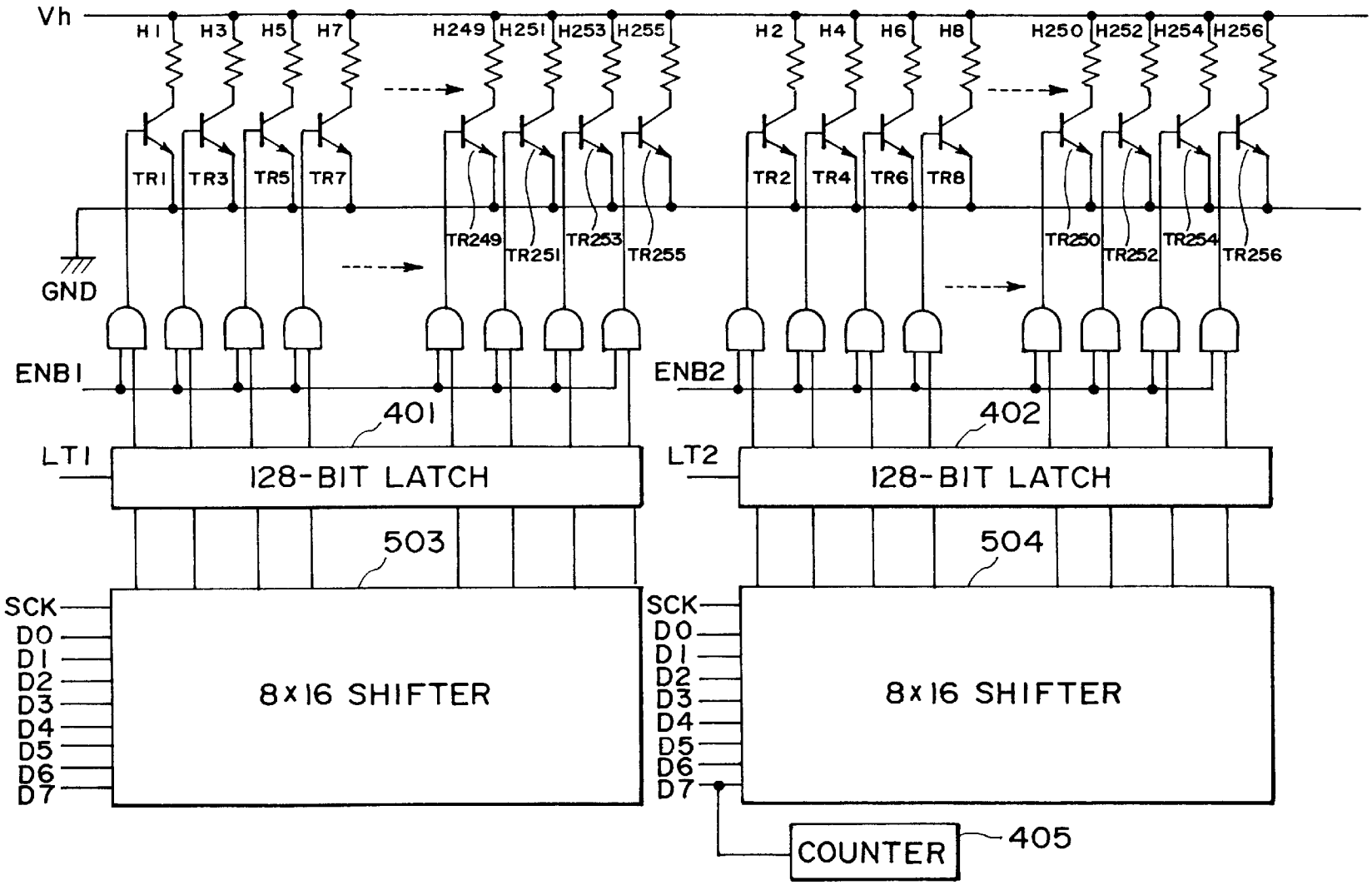
FIG. 5 shows the constitution of logic circuitry according to a second embodiment.

This embodiment provides two shifters 503 and 504 respectively comprising 8×16 bits as shown in FIG. 5 in place of the two 128-bit shift registers, and the constitution enables the input of parallel data. In FIG. 5, the same reference numbers are assigned to the same components as those in FIG. 4. In such a constitution, the total 128-bit data is input by shifting data from data signal lines D0 to D7 by 8 bits 16 times. Entire data is latched as in the embodiment shown in FIG. 4 and used as data for driving heaters.

In the constitution shown in FIG. 5, a counter 405 is connected to only the data signal line D7 to count only data of the data line. That is, data is counted every 8 ink nozzles regarding nozzles corresponding to heaters with even numbers of H2, H4, . . . , H256. In this case, precision in counting is not so good, but, there is no problem as data on control of suction recovery in a recording apparatus.

Therefore, the counter of the recording head constituted as shown in FIG. 5 to which parallel data can be input, can be also used for sufficiently high-speed recording operations if an object of use is limited.

Third Embodiment

Figure 6:
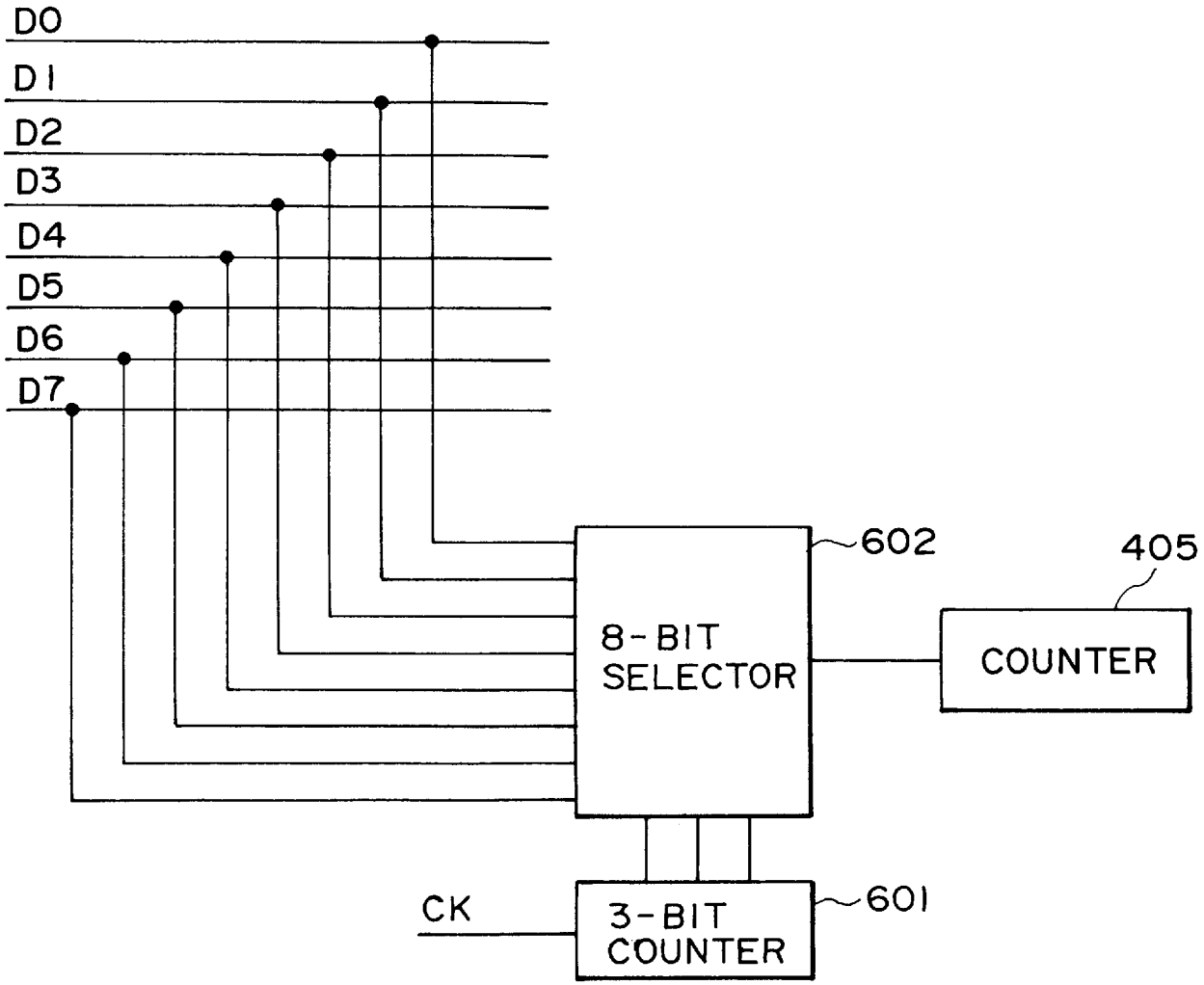
FIG. 6 shows the constitution of a circuit for counting drive data of a heater of a recording head according to a third embodiment.

In this embodiment, precision in a method for counting data shown in FIG. 5 is enhanced. In the recording head provided with 8×16-bit shifters shown in FIG. 5, data of parallel data signal lines D0 to D7 is counted using a counter and a selector as shown in FIG. 6. In FIG. 6, a reference number 601 designates a 3-bit counter for counting according to a clock signal CK, and a reference number 602 designates an 8-bit selector for selecting one of data signal lines D0 to D7 according to an output signal from the 3-bit counter 601 to connect the selected data line to the counter 405.

When, for example, a strobe pulse ENB1 or ENB2 is used as the clock signal CK in FIG. 6, the 3-bit counter 601 is counted for each emission of ink from the entire ink nozzles to sequentially change the data signal line to be connected to the counter 405, between D0 and D7 for each count. That is, data corresponding to every eight nozzles of 256 nozzles is sequentially selected every movement of one pixel in the main scanning direction of the recording head to count the data, so 1/16 of the entire area of an image to be recorded can be counted. As a result, though the number of count data is small, an area of image data for data count is evenly distributed without deviation and a counting operation with higher precision can be performed.

Further, by changing a selected signal input to the 8-bit selector, various types of count numbers can be detected. For example, when the output of the 3-bit counter 601 is changed at random, a pixel to be counted can be also at random.

As described above, according to the first to the third embodiments, as a part of record data for emitting ink from a recording head is counted, there can be realized accurate counting compatible with highspeed recording operations, that is, recording operations for a large quantity of recorded data processing per unit time. Further, since only a part of record data is counted, the constitution of circuitry can be simplified. As a result, the temperature of a recording head can be controlled correctly, the residual quantity of ink can be estimated accurately, and suction recovery can be performed at desirable timing.

Fourth Embodiment

Figure 7:
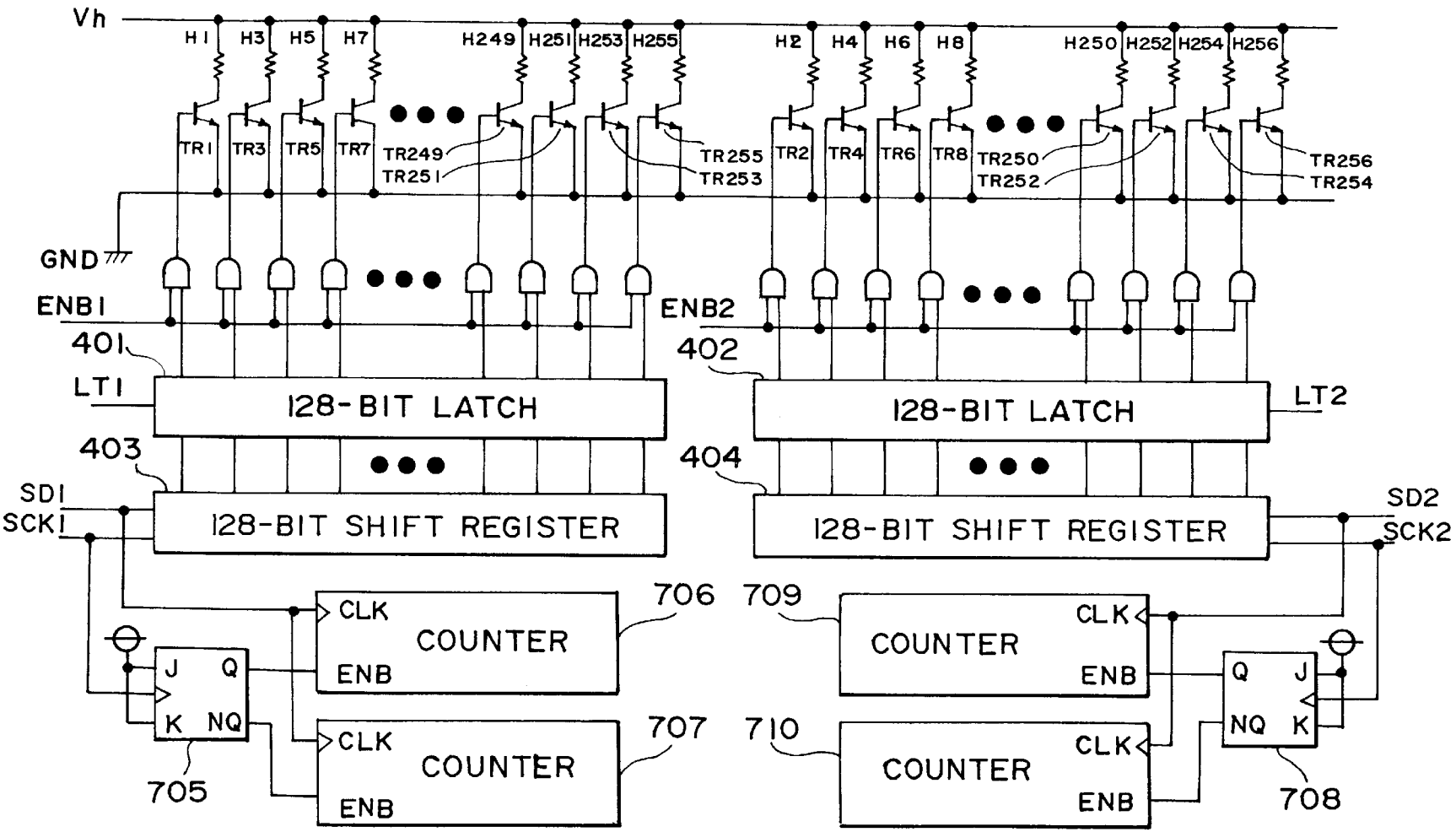
FIG. 7 is a block diagram showing the constitution for transferring drive data for each nozzle of a recording head of a fourth embodiment.

FIG. 7 is a block diagram showing the constitution for the transfer of drive data to each nozzle of the recording head for one color shown in FIG. 2, and the constitution corresponding to the counters 105K, 105Y, 105M and 105C shown in FIG. 3 (no difference is made regarding another color recording head). The frequency of emission from nozzles of each recording head can be counted.

In FIG. 7, the same reference numbers are assigned to components provided with the same function as in FIG. 4.

Reference numbers 705 and 708 designate J-K flip-flops functioning as a counter for counting transfer clocks SCK1 and SCK2 respectively, and the output Q of positive logic and the output NQ of negative logic perform toggle operations according to the transfer clock signals SCK1 and SCK2 respectively. Reference numbers 706, 707, 709 and 710 designate counters for counting transferred drive data, and SD1 and SD2 are input to clock terminals of the counters. When the level of each of SD1 and SD2 is changed from "L" to "H" counting is performed. The Q outputs of the J-K flip-flops 705 and 708 are respectively input to count enable terminals of the counters 706 and 709, and the NQ outputs of the J-K flip-flops 705 and 708 are respectively input to count enable terminals of the counters 707 and 710. The above-described counters 705 to 710 correspond to the counters 105 shown in FIG. 3.

In FIG. 7, data corresponding to each heater, in detail data for heaters H255 to H1 and data for heaters H256 to H2 are transferred respectively via signal lines SD1 and SD2 in synchronization with clocks SCK1 and SCK2 respectively. That is, clocks SCK1 and SCK2 are sent by 128 respectively. Next, when 128 pieces of data are transferred respectively and SCK1 and SCK2 are suspended, signals LT1 and LT2 are output and transferred data is latched respectively in 128-bit latches 401 and 402. That is, data corresponding to each heater is held in the 128-bit latches 401 and 402. Next, signals ENB1 and ENB2 are output, to supply a signal corresponding to data held in the 128-bit latch to each transistor TR, and ink is emitted from each nozzle by heating each heater according to the data.

At the same line when ENB1 and ENB2 are supplied and emission is performed, data on the next emission is transferred to 128-bit shift registers 403 and 404 in synchronization with the clocks SCK1 and SCK2 respectively. Similar sequences of emission are repeated to form images on a recording paper.

As each of ENB1 and ENB2 is on one signal line, the heaters H1 to H255 and the heaters H2 to H256 are heated simultaneously and timing of emission can be changed by providing a plurality of signal lines.

In an initial state, the output Q of the J-K flip-flop 705 is at the low level and the output NQ is at the high level. In the flip-flop, there is conducted a toggle operation such that the output Q is alternately at the high level and at the low level every pulse of the transfer clock SCK1 and the output NQ is alternately at the low level and at the high level. Since the output Q and the output NQ are respectively connected to the count enable terminals of the counters 706 and 707 for counting data, if the output Q of the flip-flop 705 is at the low level, and the output NQ is at the high level, the count enable terminal of the counter 706 is at the low level so no counting is performed even if SD1 is changed from the low level to the high level. But if a count enable signal of the counter 707 is at the high level and SD1 is changed from the low level to the high level, counting is performed. Next, when one pulse of SCK1 is sent, the output Q of the J-K flip-flop 705 is inverted to the high level and the output NQ is inverted to the low level to change the count enable terminal of the counter 706 to the high level and the count enable terminal of the counter 707 to the low level. Therefore, if the level of SD1 is changed from "L" to "H", counting is performed by only the counter 706.

For each one pulse of the transfer clock SCK1 as described above, either the counter 706 and or the counter 707 is in a count enabling state. Therefore, according to the above-described example, the counter 706 counts data on nozzles corresponding to the heaters H1, H5, H9, H13, . . . , of the odd number headers H1 to H255, while the counter 707 counts data on nozzles corresponding to the heaters H3, H7, H11, . . . .

Operations of the J-K flip-flops 708 and the counters 709 and 710 are also similar to those of the above-described flip-flops. The counter 709 counts data on nozzles corresponding to the heaters H2, H6, H10, H14, . . . of the even number heaters H2 to H256, while the counter 707 counts data on nozzles corresponding to the heaters H4, H8, H12, . . . . The count value of each of the counter 706, 707, 709 and 710 is read into the main controller 100 every line and then is reset.

As can be considered readily by the above description, in this embodiment, each of the counters 706, 707, 709 and 710 is operated at a frequency less than a half of a frequency of the transfer clock SCK1 or SCK2, and the maximum count may be one fourth of the number of data on the entire nozzles. Since in this embodiment, data on the entire nozzles is counted, there is no problem in precision. Further high-speed operation is enabled and the load of hardware is reduced because the maximum count by the counter is one fourth of the entire bits.

Fifth Embodiment

In the fourth embodiment, the transfer clocks SCK1 and SCK2 are counted by one-bit counters (the J-K flip-flops 705 and 708) and the two counters 706 and 707 (or 709 and 710) are changed out.

Figure 8:
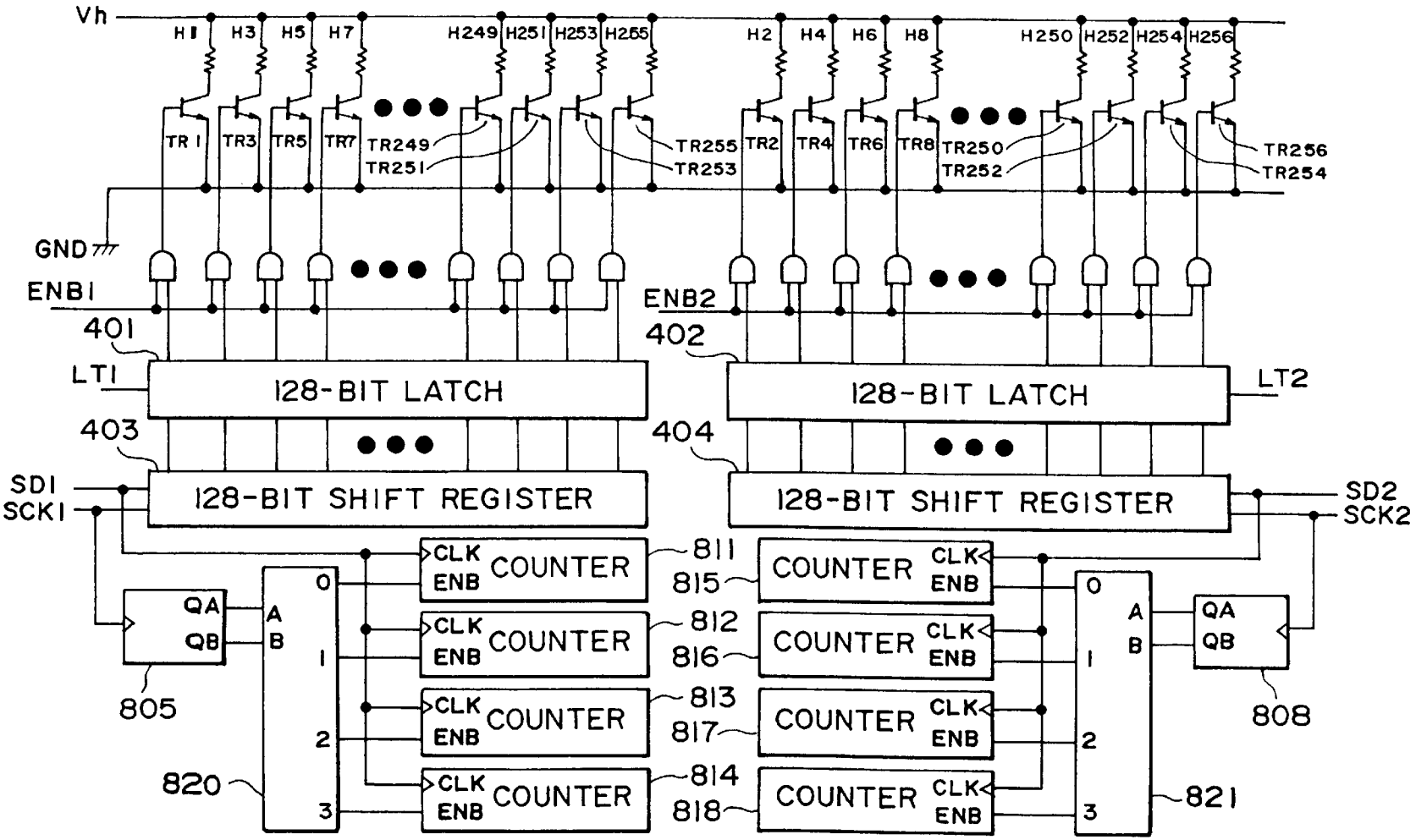
FIG. 8 is a block diagram showing the constitution for transferring drive data for each nozzle of a recording head of a fifth embodiment.

In the fifth embodiment shown in FIG. 8, SCK1 and SCK2 are counted by 2-bit counters 805 and 808, respectively, any of four counters 811, 812, 813 and 814 is selected based upon the count value of the counter 805 to count SD1, and any of four counters 815, 816, 817 and 818 is selected based upon the count value of the counter 808 to count SD2.

A selector 820 shown in FIG. 8 turns a count enable terminal of any of the counters 811, 812, 813 and 814 to "H" to permit counting SD1. A selector 821 turns a count enable terminal of any of the counters 815, 816, 817 and 818 to "H" based upon the count value of the counter 808 to permit counting SD2.

In this embodiment, each of the counters 811, 812, 813, 814, 815, 816, 817 and 818 for counting drive data is operated at a frequency less than one fourth of a frequency of the transfer clock, SCK1 or SCK2 and the maximum count is one eighth of the number of data on the entire nozzles. Therefore, the data of the entire nozzles is counted, there is no problem in precision. Further high-speed operation is enabled and the load of hardware is reduced because the maximum count of the counter is one eighth of the entire bits.

Sixth Embodiment

In the fourth and fifth embodiments, data on the entire nozzles is counted. In most of applications for forming a character and an image, data with a resolution of 300 dpi is formed. So, if only data on the nozzles with even numbers is counted in the recording head, it is manifest that double quantity of it is equal to the entire nozzles. Further, even if an image with a resolution of 600 dpi is formed by smoothing the character, etc., an error of counting is trifling.

Therefore, in this embodiment, only data in either shift register 403 or shift register 404 is counted.

As described above, according to the fourth to sixth embodiments, the number of emissions in a recording head can be counted at a high speed with precision to some extent by realizable hardware, and control for temperature of the recording head, operation for recovery and detection of residual quantity of ink can be performed effectively.

Seventh Embodiment

In this embodiment, the control board shown in FIG. 3 is used as in the first embodiment. However, a driver controller 110 also transfers data in the backward scanning (scanning in the CR direction) as well as in the forward scanning (scanning in the PT direction) of a recording head 1. But the recording head 1 is controlled so that ink is emitted only in the forward scanning. Data transfer in the backward scanning is performed by reading the same drive data as in the forward scanning from drive data RAM 110M.

Figure 9:
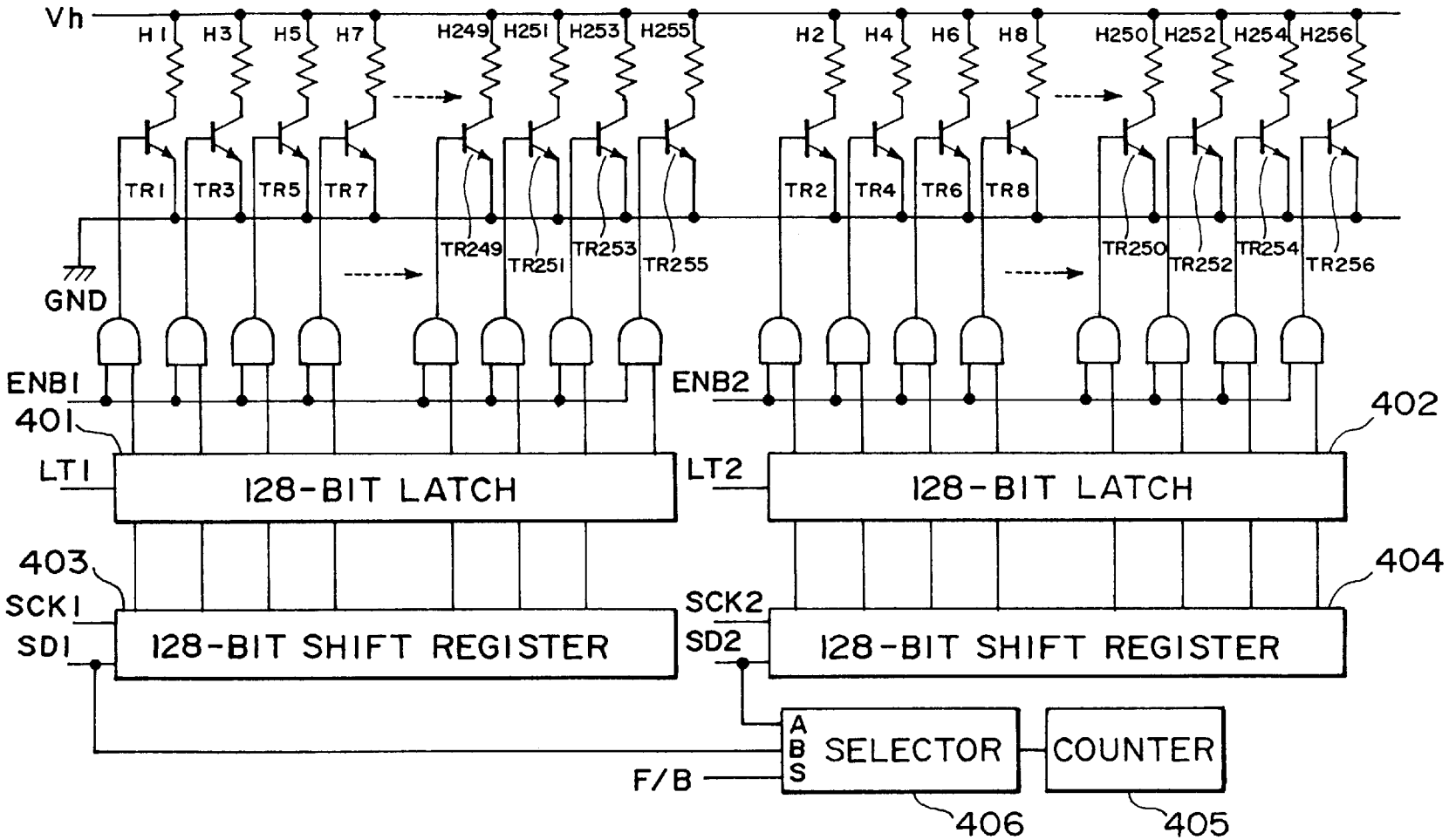
FIG. 9 shows the constitution of logic circuitry according to a seventh embodiment.

FIG. 9 shows the constitution of the circuitry in a recording head for heating nozzles using drive data transferred from a recording apparatus to emit ink from each nozzle of the recording head shown in FIG. 2. This circuit can count the frequency of emission of ink concerning nozzles of the recording head. In FIG. 9, the same reference numbers are assigned to components with the same function as those in FIG. 4.

Data corresponding to each heater transferred via signal lines SD1 and SD2 respectively is input to a circuit of the recording head shown in FIG. 9 in synchronization with clock signals SCK1 and SCK2, in response to the forward scanning operation of the carriage 4 respectively.

A counter 405 is connected to either the signal lines SD1 or SD2 via selector 406. The connection is controlled so that when the value of a signal F/B indicating that the carriage 4 is in the forward scanning or in the backward scanning is "L" (that is, the carriage is in the forward scanning), the signal line SD2 is selected, while when the value of the signal F/B is "H" (that is, the carriage is in the backward scanning), the signal line SD1 is selected, so as to be connected the counter 405. In the forward scanning, data on emission corresponding to heaters with even numbers H2 to H256 is counted and as a result, a half of data on emission corresponding to the entire nozzles 1001 to 1256 is counted. For a while, before the backward scanning is started after the forward scanning is finished, the main controller 100 stores the value counted in the forward scanning in a work area of RAM provided for the main controller, and initializes the counter 405.

In the meantime, in the backward scanning, data is transferred according to the same procedure as in the forward scanning. But, signals ENB1 and ENB2 are prevented from being output and only transfer of data is performed without emission of ink. Since in the backward scanning, data on emission corresponding to heaters with odd numbers H1 to H255 is counted, the residual half of data on emission corresponding to the entire nozzles 1001 to 1256, not counted in the forward scanning, is counted. The above-described counters 405 correspond to the counters 105 in FIG. 3.

Therefore, according to the above-described embodiment, since data on emission corresponding to the entire nozzles is counted by a half in each of the forward scanning and backward scanning of the carriage, the maximum count of the counter 405 may be a half of the number of data corresponding to the entire nozzles, so the data corresponding to the entire nozzles can be counted by one counter in this case. Thereby, the data corresponding to the entire nozzles is counted, so the data is also excellent in precision. Further, the constitution of circuitry is simpler and high-speed counting sufficiently compatible with high-speed recording is enabled.

In the above-described embodiment, a recording apparatus which emits ink for recording only when the carriage 4 is in the forward scanning, is described. However, the present invention is not limited to such a recording apparatus. For example, the invention can be also applied to a recording apparatus wherein ink is also emitted in the backward scanning to enhance throughput. That is, the present invention can be applied to a reciprocatingly recordable recording apparatus. Such a recording apparatus must be so arranged that data can be transferred in either the forward scanning or the backward scanning. This is achieved by the same constitution as that shown in FIG. 9 in view of counting data on emission.

Eight Embodiment

In the above-described seventh embodiment, counting of data on emission as noting data for urging emission of ink from the recording head, is described.

That is, the recording head described in the above-described seventh embodiment can record with a resolution of 600 dpi in the sub-scanning direction. However, actually, most of application programs for forming a character dot pattern and an image processes data with resolution of 300 dpi. Therefore, in such a case, if only data on emission of ink from the nozzles with even numbers is counted in the above-described recording head, it is manifest that the double quantity of it is equivalent to the entire nozzles.

In a case where a character pattern image with a resolution of 600 dpi obtained by smoothing a character dot pattern with a resolution of 300 dpi is recorded using the above-described recording head which can record with high resolution, an error of counting is trifling compared with a case where data on emission for the original character dot pattern with a resolution of 300 dpi is counted, even if data on emission for a character pattern image with a resolution of 600 dpi is counted. Also, no effect is given on each processing for control of recording, performed based upon a count.

Further, in a case where an image with high resolution is output by performing pseudo intermediate processing for input image data, there is also no problem because randomness for used nozzles is sufficient. When recording is to be performed using the above-described recording head, recording control called multi-pass recording is often used. In such a case, even if only data on emission from only nozzles with even numbers is counted, good precision in counting can be obtained because data on each emission is delivered for every nozzle.

Figure 10:
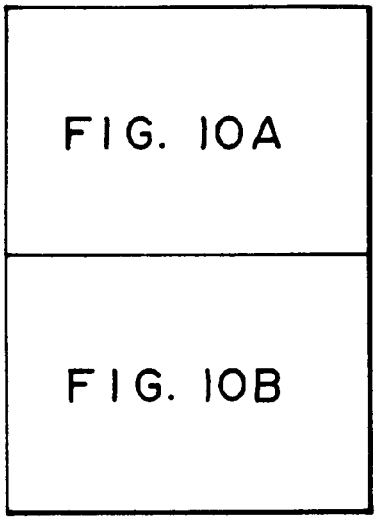
FIG. 10, composed of FIGS. 10A and 10B, shows the constitution of logic circuitry according to an eighth embodiment.
Figure 12:
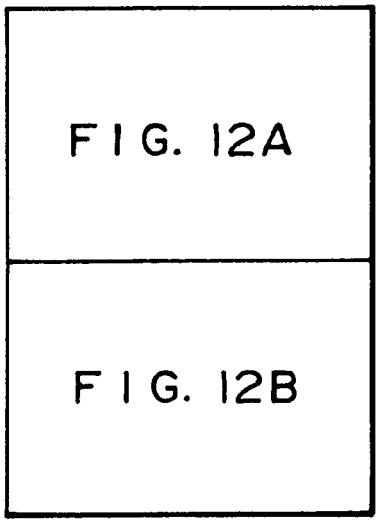
FIG. 12, composed of FIGS. 12A and 12B shows the constitution of logic circuitry according to a tenth embodiment.
Figure 10A:
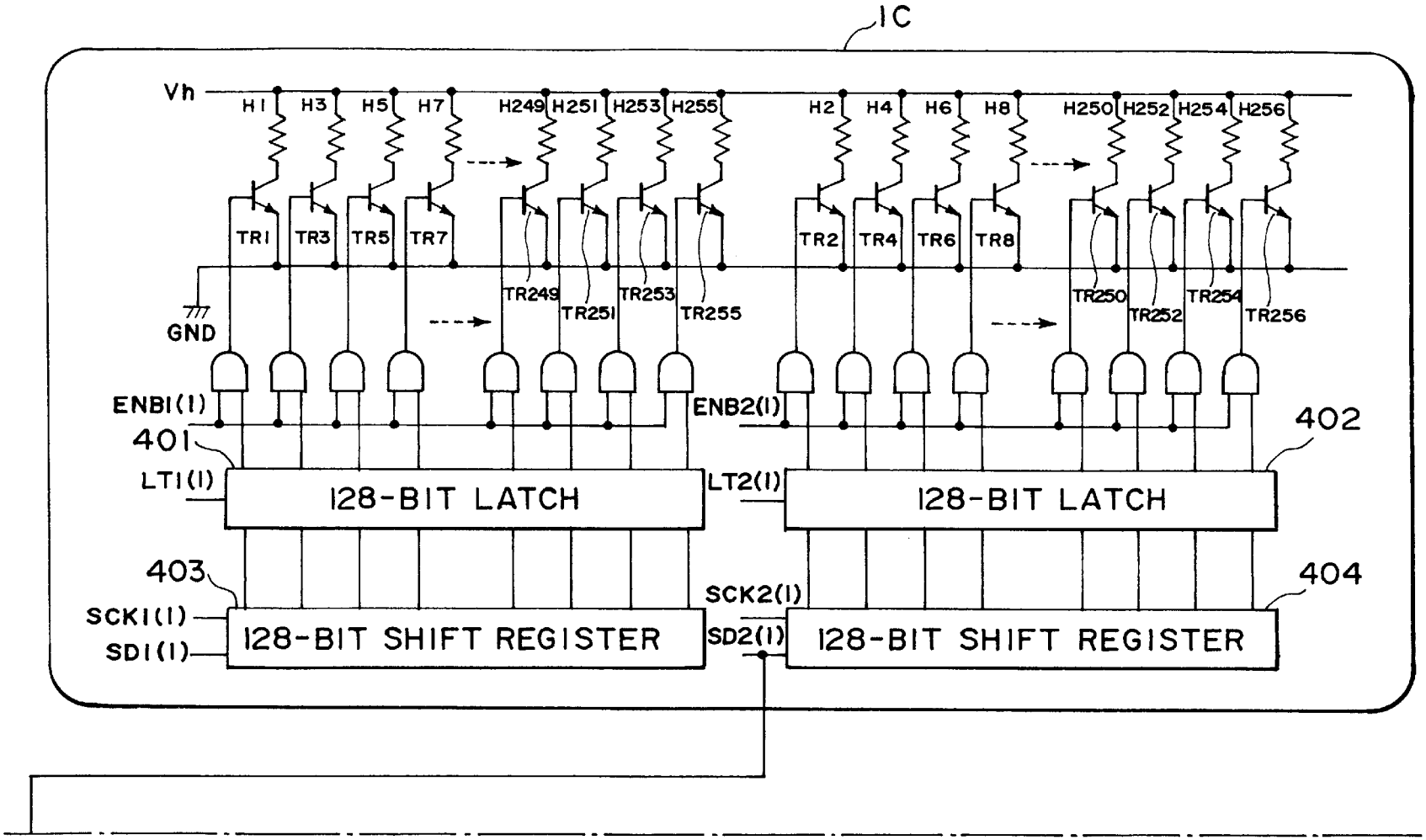
Figure 10B:
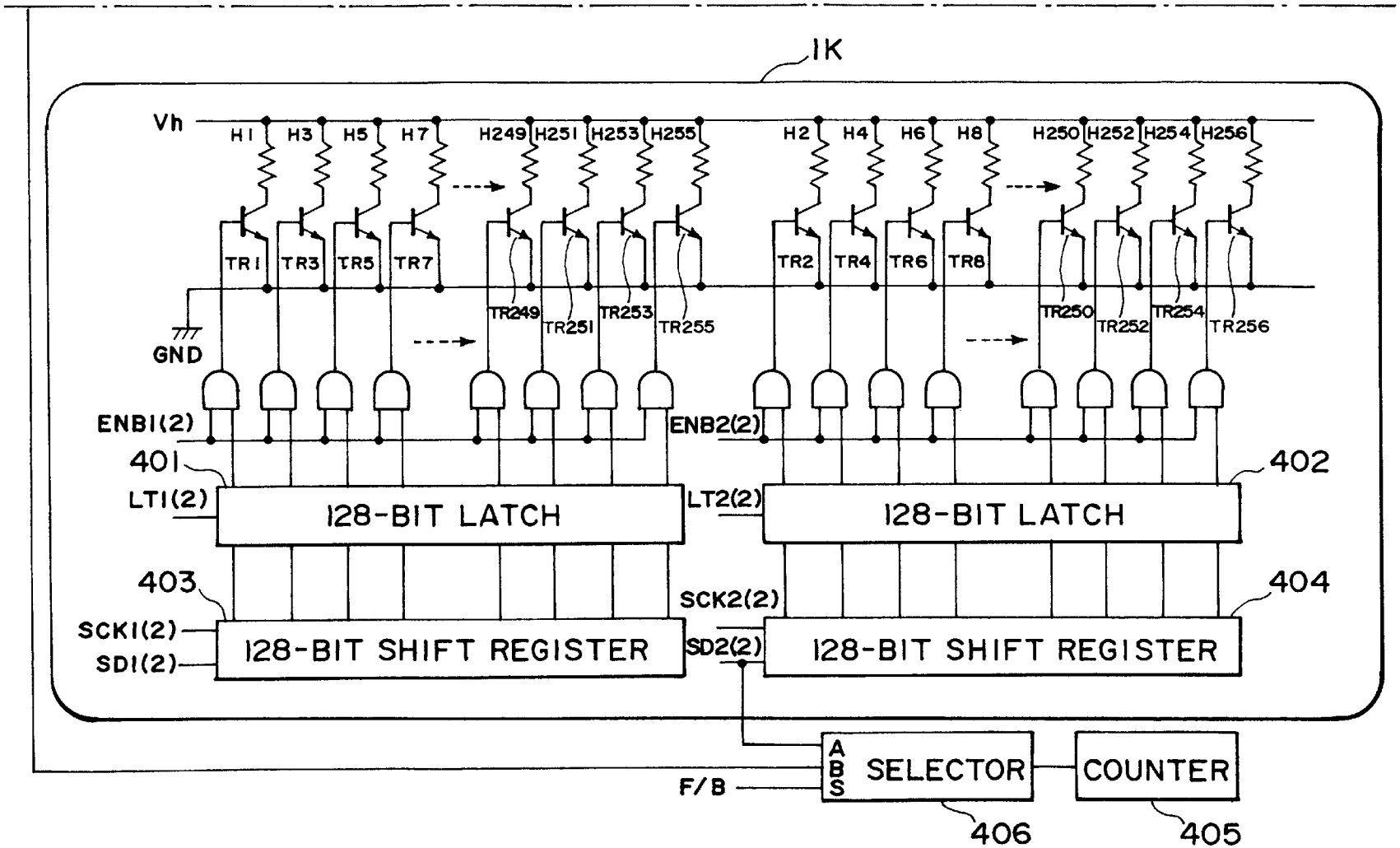

In the eighth embodiment, data on emission input to two recording heads is counted by one counter as shown in FIGS. 10A and 10B.

FIGS. 10A and 10B show the constitution of the circuitry for counting data on emission as noting data urging emission of ink from two recording heads, for example recording heads 1K and 1C with the same constitution. In this constitution, the counters 105K and 105C shown in FIG. 3 are shared as one counter. The constitution of the circuitry for the recording heads 1K and 1C shown in FIG. 5 is similar to that shown in FIG. 4 and the same reference numbers are assigned. Signals (lines) input to the recording heads 1K and 1C are also common. But, to differentiate signals (lines) input to the recording heads 1K and 1C, (1) is given to an input signal (line) to the recording head 1C, while, (2) is given to the input signal to a recording head 1K.

In FIGS. 10A and 10B, a counter 405 is selectively connected to either a signal line SD2 (1) in the recording head 1C or a signal line SD2 (2) in the recording head 1K. The connection is controlled so that when the value of a select signal F/B supplied via a head driver 114 is "L" (that is, in the forward scanning), the signal line SD2 (1) is selected, while when the value of the signal F/B is "H" (that is, in the backward scanning), the signal line SD2 (2) is selected, so as to be connected to the counter 405. Therefore, in the forward scanning, data on emission corresponding to heaters with even numbers H2 to H256 in the recording head 1C is counted and in the backward scanning, data on emission corresponding to heaters with even numbers H2 to H256 in the recording head 1K is counted. When the forward scanning is finished, a main controller 100 stores the counted value in a work area of RAM provided for the main controller and initializes the counter 405.

As described above, in the forward scanning, only data on emission corresponding to the nozzles with even numbers in the recording head 1C is counted, in the meantime, in the backward scanning, only data on emission corresponding to the nozzles with even numbers in the recording head 1K is counted. Thus, even if only a half of data on emission corresponding to the entire nozzles of the two recording heads is counted, sufficient precision in counting can be obtained. Since the number of counters is reduced in such a constitution, a constitution of the circuitry can be simplified.

Ninth Embodiment

Figure 11:
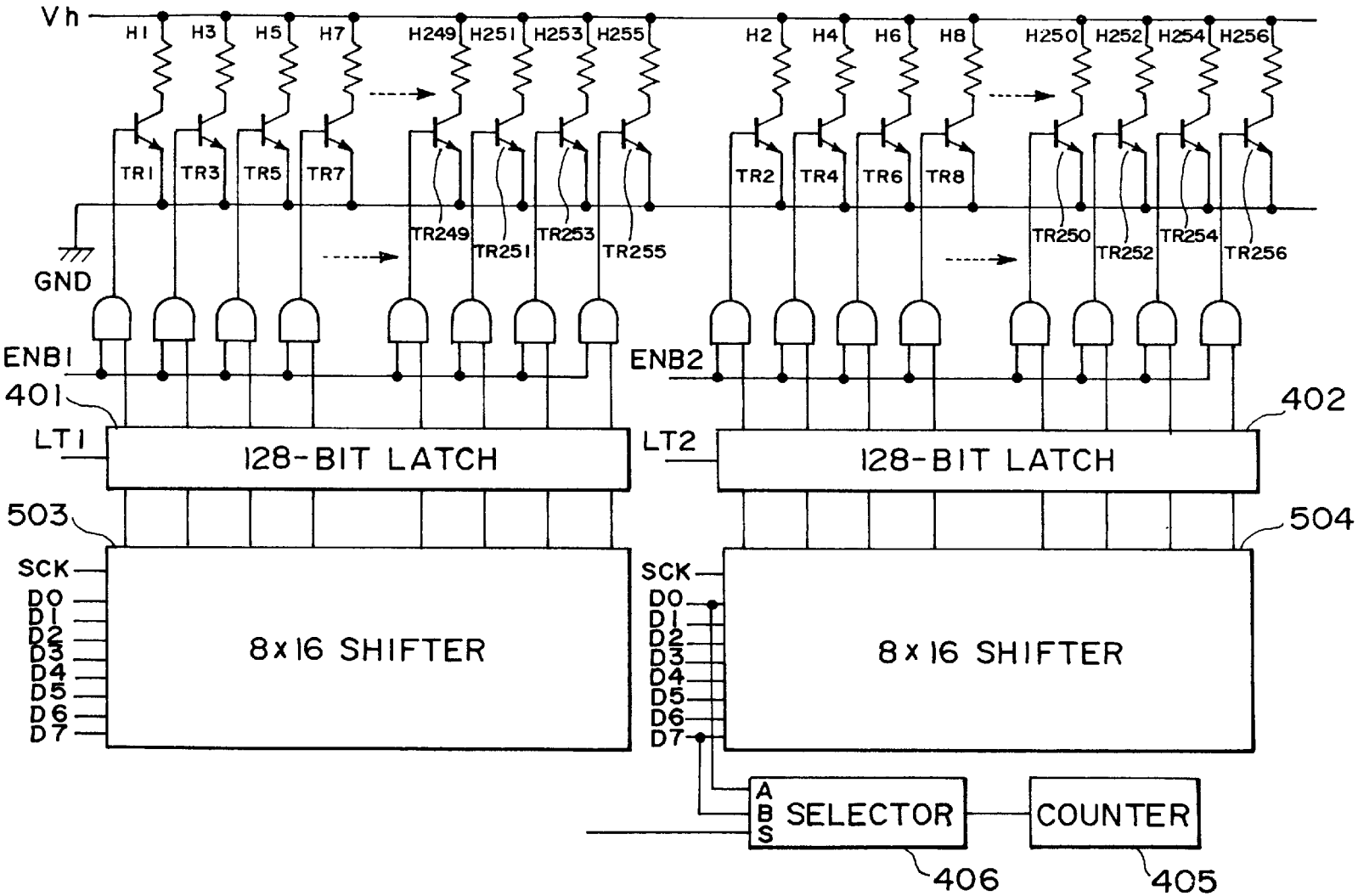
FIG. 11 shows the constitution of logic circuitry according to a ninth embodiment.

The invention is not limited to a constitution of the circuitry of the recording heads shown in FIGS. 9 to 10B. For example, as shown in FIG. 11, a constitution having two 8×16-bit shifters 503 and 504 may be substituted for two 128-bit shift registers so as to enter parallel data. In FIG. 11, the same reference numbers are assigned to the same components as those in FIG. 5. In the case of such a constitution, the total 128-bit data is input by shifting data from data signal lines D0 to D7 by 8 bits 16 times. The entire data is latched as in the embodiment shown in FIG. 5 and is used as data for driving heaters In the constitution shown in FIG. 11, a counter 405 is connected to the data signal conductor D0 or D7 via a selector 406. The selector 406 is controlled so that when the value of a selected signal F/B is "L" (that is, in the forward scanning), the data signal line D0 is selected, while when the value of a selected signal F/B is "H" (that is, in the backward scanning), the data signal conductor D7 is selected, so as to connected to the counter 405. When the forward scanning is finished, a main controller 100 stores the counted value in a work area of RAM provided for the main controller and initializes the counter 405.

According to the above-described constitution, in this embodiment, data on emission every 8 ink nozzles corresponding to heaters with even numbers H2, H4 . . . H256 in each of the forward and backward scanning is counted because only the data of the data signal line D0 is counted in the forward scanning and only the data of the data signal line D7 is counted in the backward scanning. But, since data of the different data signal lines are counted between the forward scanning and the backward scanning, data every 8 of the entire nozzles is actually counted. While this is not so preferable in view of precision in counting, there is no problem for usage as data for controlling suction recovery for a recording apparatus. Also, precision in counting required for controlling specific recording can be secured by changing the constitution of the circuitry to the minimum extent. Such a constitution can be applied whether recording by reciprocating is enabled or not.

Therefore, according to this embodiment, the counter of the recording head, which enters parallel data, constituted as shown in FIG. 11 can be used for sufficiently high-speed recording operation if the purpose of use is limited.

Tenth Embodiment

Figure 12A:
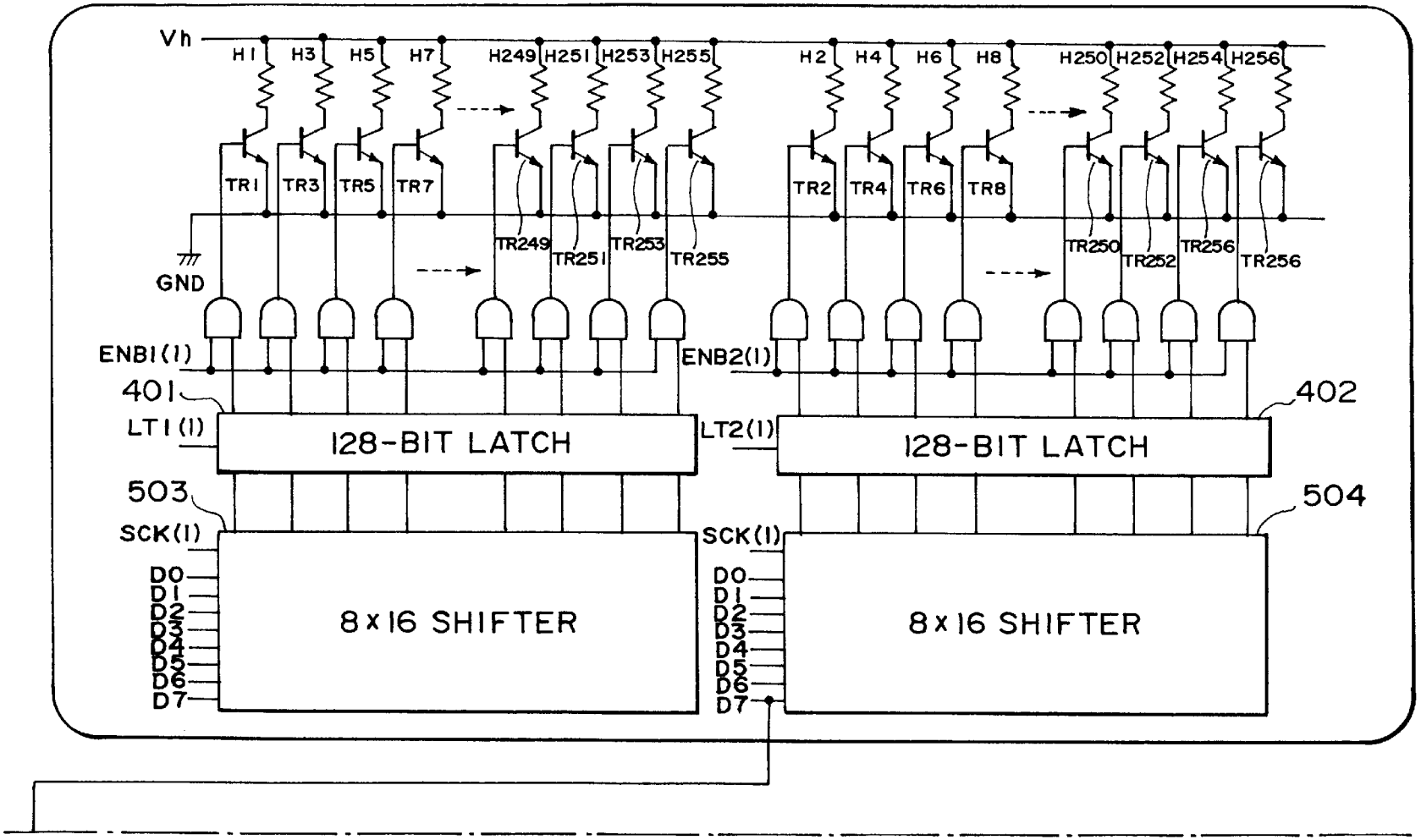
Figure 12B:
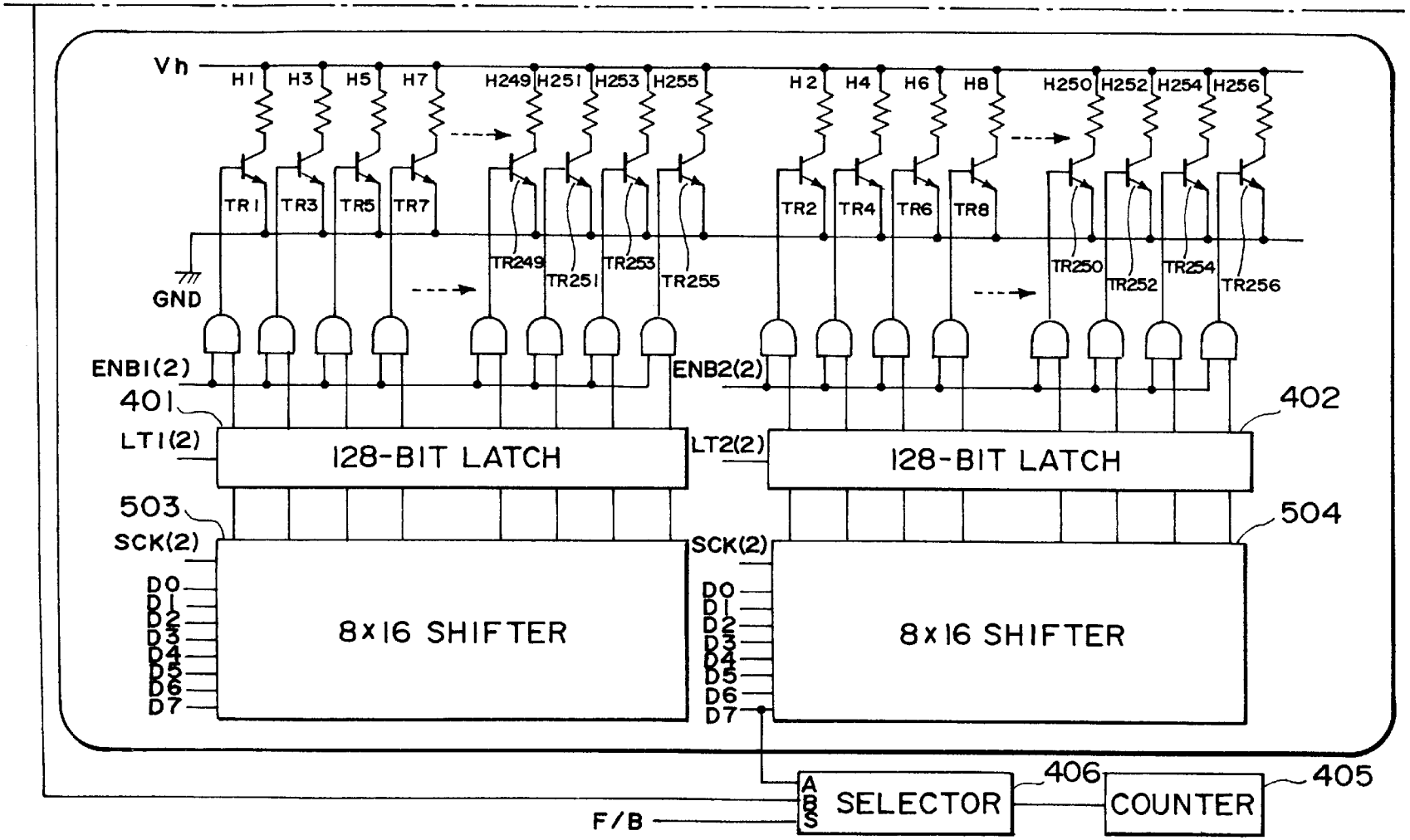

As described in the above-described eighth embodiment, a circuit for counting data on emission may be constituted so that one counter counts data on emission from two recording heads constituted as shown in FIG. 11. FIGS. 12A and 12B show an example of such circuit. The circuit shown in FIGS. 12A and 12B counts data on emission as noting data urging emission of ink from the recording heads 1K and 1C having the same constitution, similarly as the constitution shown in FIGS. 10A and 10B. Therefore, in such a constitution, the counters 105K and 105C shown in FIG. 3 are shared as one counter. The constitution of the circuitry in the recording heads 1K and 1C shown in FIGS. 12A and 12B is similar to that shown in FIG. 4 and the same reference numbers are assigned. Signals (lines) input to the recording heads 1K and 1C are also common. However, to differentiate signals (lines) input to the recording heads 1K and 1C, (1) is added to a signal (line) input to the recording head 1C while (2) is added to a signal (line) input to the recording head 1K.

In this case, since in the forward scanning only data of the data signal line D7 of the recording head 1C is counted and in the backward scanning only data of the data signal line D7 of the recording head 1K is counted, actually data on every 16 of the entire nozzles is counted regarding each recording head. This is not so preferable in view of precision in counting, but, only one counter for two recording heads is required and thus it provides a profit that increase of a circuit can be minimized. Therefore, such constitution may be used for control of suction recovery not required for high precision in counting.

Figure 13:
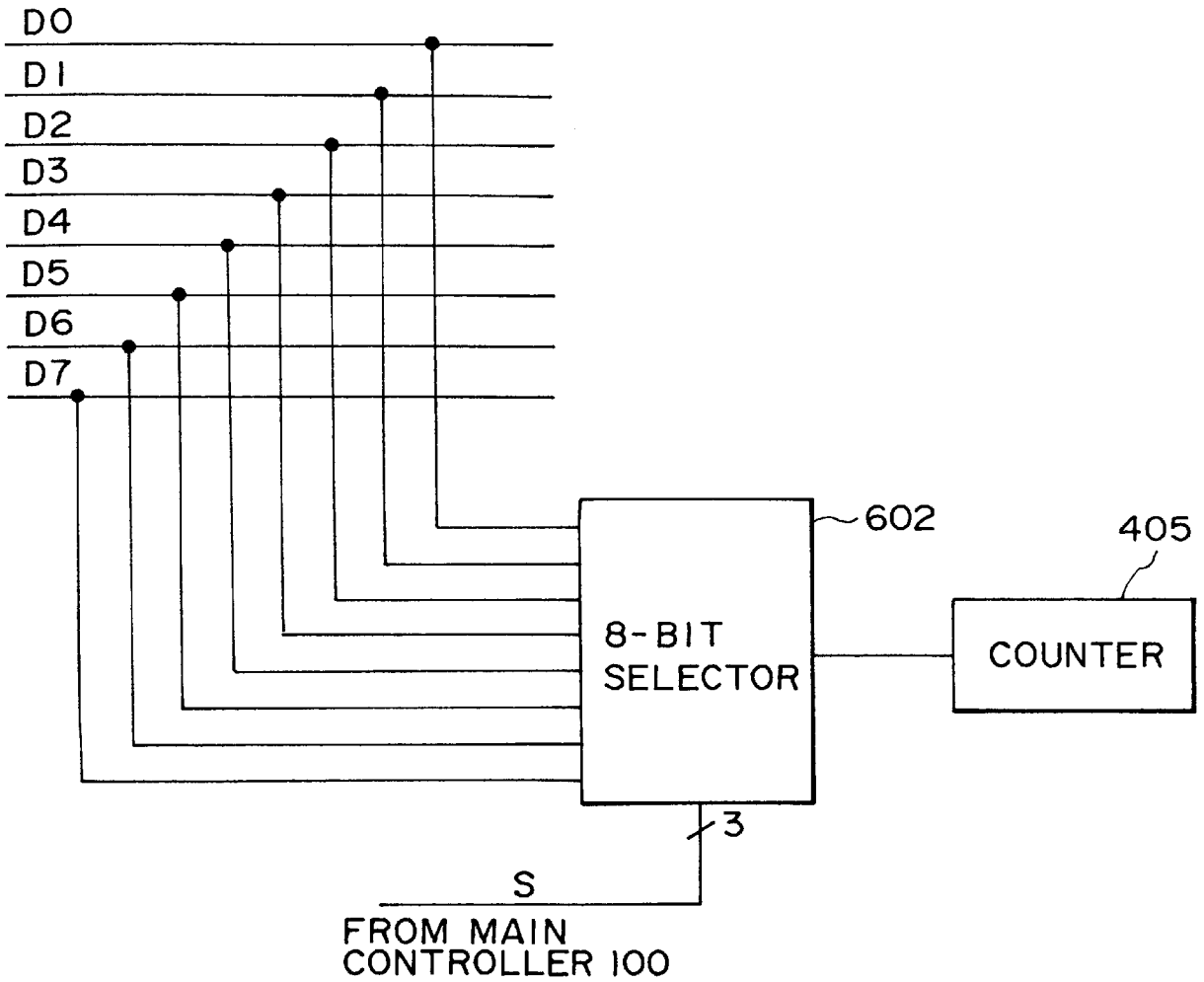
FIG. 13 shows the constitution of a circuit for counting heater drive data for a recording head shown in FIG. 11.

Further, in the recording head provided with 8×16-bit shifters shown in FIG. 11, data on the parallel data signal lines D0 to D7 may be counted using the counter and the selector shown in FIG. 6. In FIG. 13, a reference number 602 designates an 8-bit selector for selecting one of data signal lines D0 to D7 and connecting it to a counter 405 by a 3-bit control signal S supplied by the main controller 100. The control signal S is supplied so that a different data signal line may be selected between the forward scanning and the backward scanning of the carriage 4.

In this constitution, data equivalent to 1/16 of the entire area of recorded images is counted in each of the forward scanning and the backward scanning. However, since a data signal line selected in the forward scanning and a data signal line selected in the backward scanning are different, actually 1/8 of the entire area of images is counted in the forward and backward scannings. Any type of data signal line selection may be permitted if data signal lines selected between the forward scanning and the backward scanning are different.

Subsequently, if the control signal S from the main controller 100 to the 8-bit selector 602 changes every scanning, an area of image data subjected to data counting is uniformly distributed without deviation and data can be counted with higher precision in counting though its amount is small.

Eleventh Embodiment

Figure 14:
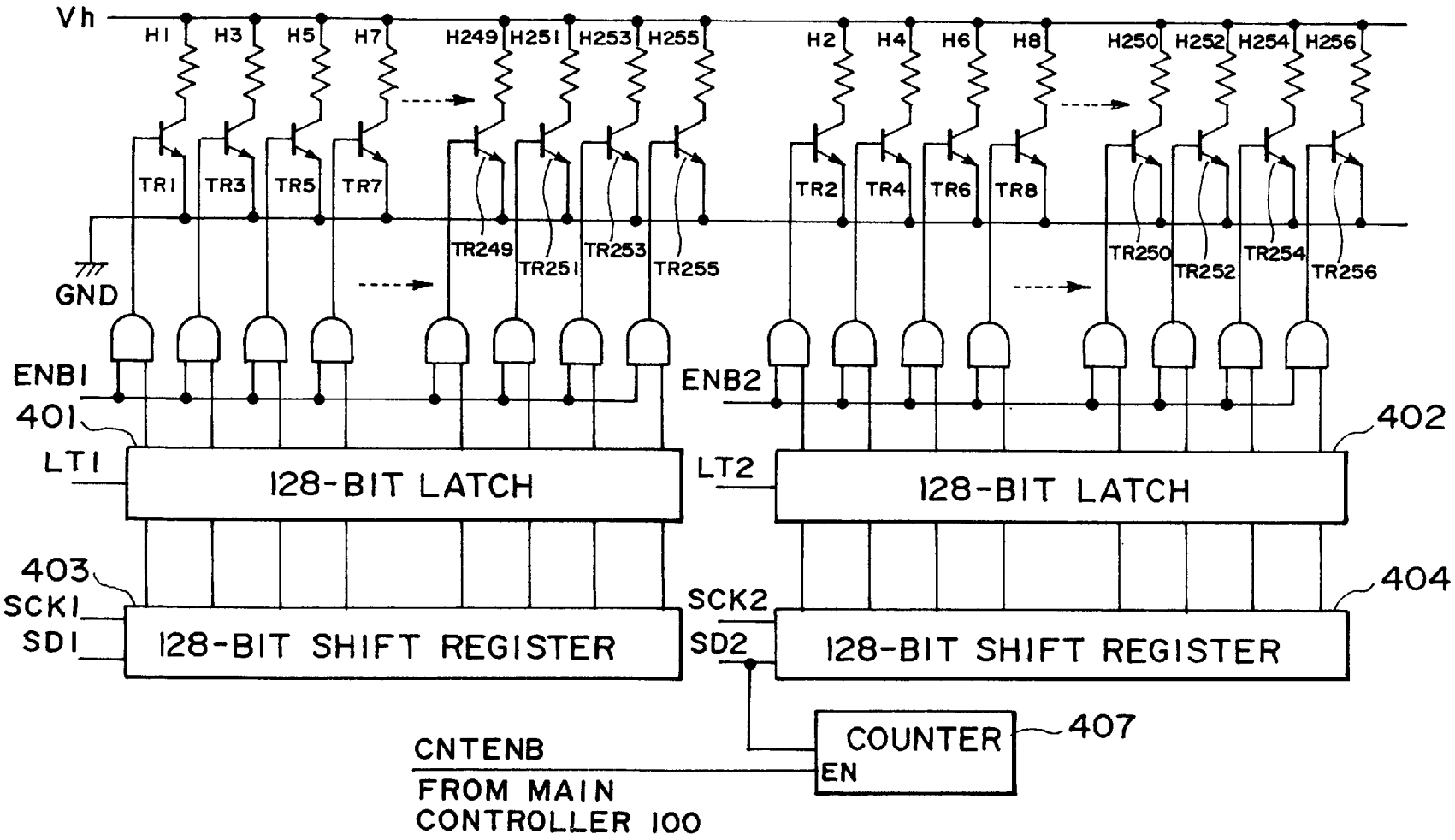
FIG. 14 shows the constitution of logic circuitry according to an eleventh embodiment.

FIG. 14 is a block diagram showing the constitution of the circuitry provided with a counter 407 controlled by a control signal CNTENB from the main controller 100, wherein the selector 406 is removed from the constitution shown in FIG. 9. The other constitution in FIG. 14 is similar to the constitution in FIG. 9 and the same reference numbers are assigned.

Figure 15:
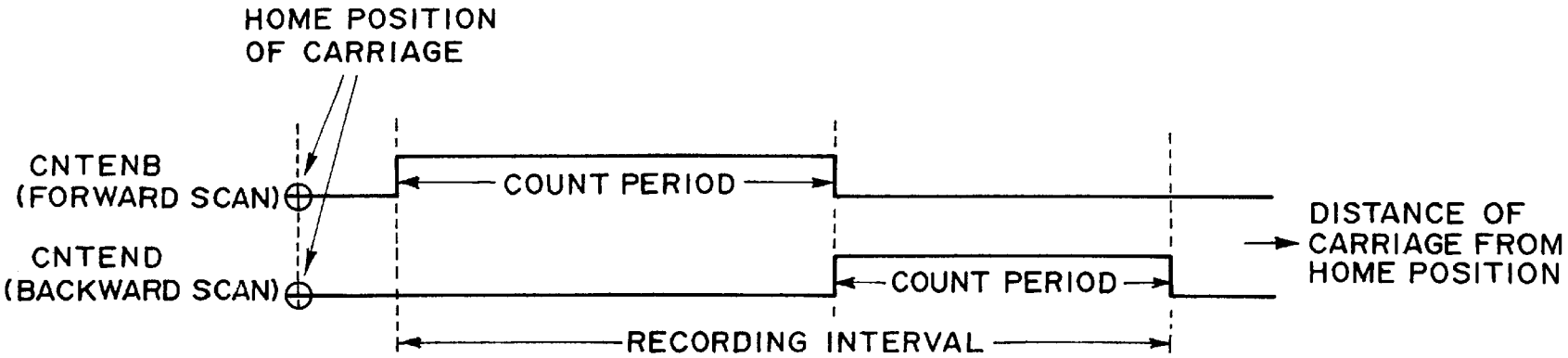
FIG. 15 is a time chart showing control timing of a control signal CNTENB.

The counter 407 is connected to a data signal line SD2 and ON/OFF of its counting operation is controlled by the control signal CNTENB. That is, as shown in FIG. 15, the main controller 100 controls the counter 407 by a control signal CNTENB so as to count only during a predetermined time (or interval) of the forward scanning of the carriage 4 and to count in the backward scanning regarding the time or interval not counted in the forward scanning. If the length of the time when counting is performed in the forward scanning is equal to that when counting is performed in the backward scanning, ½ of data corresponding to nozzles with even numbers which is ½ of data corresponding to the entire nozzles may be counted in the forward and backward scanning respectively. To count ½ of data corresponding to the entire nozzles, the maximum count of the counter 407 may be ¼ of the number of data corresponding to the entire nozzles.

In this embodiment, the constitution for counting data corresponding to ½-of the entire nozzles has been described. As before-described, the recording head can record with a resolution of 600 dpi in the subscanning direction. But, in consideration of the data resolution (such as 300 dpi) required in an actual application program, even if only data corresponding to nozzles with even numbers as shown in this embodiment is counted, sufficient precision in counting can be obtained.

In the present embodiment, the length of the time when counting is performed in the forward scanning is equal to that when counting is performed in the backward scanning. But even if both lengths are different, the effect of this embodiment is not damaged taking into consideration the maximum count of the counter 407.

As described above, according to the seventh to the eleventh embodiments, since record data for generating emission of ink from the first recording head provided with a plurality of nozzles is counted in the forward and backward scannings during reciprocating scan of the first recording head, there is provided an effect that accurate counting compatible with high-speed recording operation (that is, processing of a large quantity of recording data per unit time) is enabled. As a result, temperature in the recording head can be controlled correctly, detection of residual quantity of ink can be conducted precisely, and operation for suction recovery can be performed at desirable timing.

The present invention is particularly suitable for use in an ink jet recording head and recording apparatus wherein thermal energy generated by an electrothermal transducer, a laser beam or the like is used to cause a change of state of the ink to eject or discharge the ink. This is because the high density of the picture elements and the high resolution of the recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include a capping means for the recording head, cleaning means therefore, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head, it may be a single head corresponding to a single color ink, or may be plural heads corresponding to the plurality of ink materials having different recording colors or densities. The present invention is effectively applied to an apparatus having at least one of a monochromatic mode mainly with black, a multicolor mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below the room temperature but liquid at room temperature. Since the ink is kept within a temperature between 30° C. and 70° C., in order to stabilize the viscosity of the ink to provide the stabilized ejection in the usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, in response to the application of the recording signal producing thermal energy, the ink is liquified, and the liquified ink may be ejected. Another ink material may start to be solidified at the time when it reaches the recording material.

The present invention is also applicable to such an ink material as is liquified by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one of the techniques described above is the film boiling system.

The ink jet recording apparatus may be used as any output terminal of an information processing apparatus such as a computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus for recording on a recording medium using a recording head provided with a plurality of recording elements, on the basis of recording data inputted from a host computer, said apparatus comprising:

a memory for storing the inputted recording data;

transfer means, coupled to said memory, for transferring to the recording head drive data based upon the recording data stored in said memory, via a plurality of data lines, wherein a resolution of the drive data is higher than that of the recording data;

drive means, coupled to said transfer means, for driving the recording head according to the drive data transferred by said transfer means; and count means provided for the recording head and for counting the drive data transferred over a part of, but not all of, the plurality of data lines by said transfer means.

2. A recording apparatus according to claim 1, wherein said count means counts the number of drive data required for driving a half of said plurality of recording elements.

3. A recording apparatus according to claim 2, wherein said half of said plurality of recording elements are either odd or even recording elements of said recording head.

4. A recording apparatus according to claim 1, further comprising drive control means for estimating temperature in said recording head according to a count value counted by said count means, and for controlling said drive means according to the estimated temperature.

5. A recording apparatus according to claim 1, wherein said recording head emits ink for recording.

6. A recording apparatus according to claim 5, further comprising suction recovery control means for controlling suction recovery for the nozzles of said recording head according to a count value counted by said count means.

7. A recording apparatus according to claim 5, further comprising ink residual quantity estimate means for estimating a residual quantity of ink used by said recording head according to a count value counted by said count means.

8. A recording apparatus according to claim 1, wherein said recording (1) head emits ink utilizing thermal energy, and (11) is provided with a thermal energy converter for generating thermal energy to be provided to the ink.

9. A recording apparatus according to claim 1, wherein said transfer means serially transfers drive data to said recording head.

10. A recording apparatus according to claim 1, wherein said transfer means transfers drive data to said recording head in parallel.

11. A recording apparatus according to claim 10, wherein said count means counts data on a part of plural data lines used for transferring data in parallel.

12. A recording apparatus according to claim 11, wherein said part of plural data lines subjected to counting by said count means is changed for each recording operation.

13. A recording apparatus according to claim 1, where in said count means counts drive data transferred to specific recording elements of said plurality of recording elements.

14. A recording apparatus according to claim 1, wherein said count means count s drive data transferred to recording elements of said plurality of recording elements, which elements are changed for each recording operation.

15. A recording apparatus according to claim 1, further comprising scanning means for scanning said recording head.

16. A recording apparatus according to claim 1, further comprising carriage means for carrying said recording medium.

17. A recording method for recording on a recording medium using a recording head provided with a plurality of recording elements, on the basis of recording data inputted from a host computer, said method comprising the steps of:

storing the inputted recording data;

transferring to the recording head drive data based upon the stored input recording data, via a plurality of data lines, wherein a resolution of the drive data is higher than that of the recording data;

driving the recording head according to the drive data transferred in the transferring step; and counting in response to the recording head the drive data transferred over a part of, but not all of, the plurality of data lines in the transferring step.

18. A recording method according to claim 17, wherein in the counting step, the number of drive data required for driving a half of said plurality of recording elements is counted.

19. A recording method according to claim 18, wherein said half of said plurality of recording elements are either odd or even recording elements of said recording head.

20. A recording method according to claim 17, wherein in the transferring step, the drive data is serially transferred to said recording head.

21. A recording method according to claim 17, wherein in the transferring step, the drive data is transferred to said recording head in parallel.

22. A recording method according to claim 21, wherein in the counting step, data on a part of plural data lines for transferring data in parallel is counted.

23. A recording method according to claim 22, wherein said part of said plural data lines subjected to counting in the counting step is changed for each recording operation.

24. A recording apparatus for recording on a recording medium using a recording head provided with a plurality of recording elements, comprising:

a memory for storing input recording data;

drive means, coupled to said memory, for driving the recording head according to drive data based upon the input recording data stored in said memory;

transfer means, coupled to said drive means, for transferring drive data allocated to said plurality of recording elements to said recording head via the same signal line in synchronization with a transfer clock signal;

count means for counting the drive data transferred on said same signal line by said transfer means;

wherein said count means comprises (i) a plurality of counters parallel-connected to said same signal line, and (ii) selecting means for selecting any of the plurality of counters in response to said transfer clock signal; and wherein said any of the plurality of counters selected by said selecting means counts the drive data allocated to said plurality of recording elements.

25. A recording apparatus according to claim 24, wherein said selecting means (i) comprises a clock counter for counting said transfer clock signal, and (ii) selects any of said plurality of counters according to a count value in said clock counter.

26. A recording apparatus according to claim 24, further comprising drive control means for estimating a temperature in said recording head according to a count value counted by said count means, and for controlling said drive means according to the estimated temperature.

27. A recording apparatus according to claim 24, wherein said transfer means emits ink for recording.

28. A recording apparatus according to claim 27, further comprising suction recovery control means for controlling suction recovery for the nozzles of said recording head according to a count value counted by said count means.

29. A recording apparatus according to claim 24, further comprising ink residual quantity estimate means for estimating a residual quantity of ink consumed by said recording head according to a count value counted by said count means.

30. A recording apparatus according to claim 24, wherein said count means counts a part of the drive data transferred by said transfer means.

31. A recording apparatus according to claim 24, wherein said transfer means serially transfers drive data to said recording head.

32. A recording apparatus according to claim 24, further comprising scanning means for scanning said recording head.

33. A recording apparatus according to claim 24, further comprising carriage means for carrying said recording medium.

34. A recording method for recording on a recording medium using a recording head provided with a plurality of recording elements, comprising the steps of:

storing input recording data;

driving the recording head according to drive data based upon the input recording data stored in said storing step;

transferring drive data allocated to said plurality of recording elements to said recording head via the same signal line in synchronization with a transfer clock signal; and counting the drive data transferred on said same signal line in said transferring step using a plurality of counters parallel-connected to said same signal line, and selecting any one of the plurality of counters in response to the transfer clock signal, wherein in the counting step, any of the plurality of counters selected in response to the transfer clock signal counts the drive data allocated to said plurality of recording elements.

35. A recording method according to claim 34, wherein in the counting step, a part of the drive data transferred in the transferring step is counted.

36. A recording method according to claim 34, wherein in the transferring step, the drive data is transferred to said recording head in parallel.

37. A recording apparatus for recording on a recording medium using a recording head provided with a plurality of recording elements, on the basis of recording data inputted from a host computer, said apparatus comprising:

scanning means for reciprocatingly scanning said recording head for recording;

a memory for storing the inputted recording data;

transfer means for transferring to the recording head drive data based upon the input recording data stored in said memory, via a plurality of data lines, wherein a resolution of the drive data is higher than that of the recording data;

drive means for driving the recording head according to the drive data transferred by said transfer means; and count means for counting the drive data transferred over a part of, but not all of, the plurality of data lines by said transfer means, in forward and backward scans of the recording head.

38. A recording apparatus according to claim 37, wherein said count means counts drive data for driving a half of said plurality of recording elements of said recording head in said forward scan; and counts drive data for driving the residual half of recording elements in said backward scan.

39. A recording apparatus according to claim 38, wherein said half of recording elements are odd or even recording elements.

40. A recording apparatus according to claim 37, wherein said count means counts a part of said drive data.

41. A recording apparatus according to claim 40, wherein the recording elements subjected to counting by said count means are changed for each drive.

42. A recording apparatus according to claim 40, wherein said recording elements subjected to counting by said count means are fixed.

43. A recording apparatus according to claim 40, wherein different recording elements are subjected to counting by said count means between said forward scan and said backward scan.

44. A recording apparatus according to claim 37, further comprising another recording head provided with a plurality of recording elements of the same number as that of the recording elements of said recording head, and wherein said scanning means reciprocatingly scans said another recording head together with said recording head.

45. A recording head according to claim 44, wherein said count means counts drive data for driving a half of the plurality of recording elements of said recording head in said forward scan, and counts drive data for driving a half of the plurality of recording elements of said another recording head in said backward scan.

46. A recording apparatus according to claim 37, wherein said transfer means serially transfers drive data to said recording head.

47. A recording apparatus according to claim 37, wherein said transfer means transfers drive data to said recording head in parallel.

48. A recording apparatus according to claim 47, wherein said count means counts data on a part of plural data lines for transferring data in parallel.

49. A recording apparatus according to claim 48, wherein a part of the data lines subjected to counting by said count means is changed for each recording operation.

50. A recording apparatus according to claim 48, further comprising selecting means for selecting one or more of said plural data lines which are subjected to counting by said count means.

51. A recording apparatus according to claim 37, further comprising drive control means for estimating a temperature in said recording head based upon a count value counted by said count means for controlling said drive means according to the estimated temperature.

52. A recording apparatus according to claim 37, wherein said recording head comprises an ink jet recording head for emitting ink for recording.

53. A recording apparatus according to claim 51, further comprising suction recovery control means for controlling suction recovery for the nozzles of said recording head according to a count value counted by said count means.

54. A recording apparatus according to claim 52, further comprising ink residual quantity estimate means for estimating residual quantity of ink consumed by said recording head according to a count value counted by said count means.

55. A recording apparatus according to claim 37, wherein said recording head is a recording head for emitting ink utilizing thermal energy, and is provided with a thermal energy converter for generating thermal energy to be provided to the ink.

56. A recording apparatus according to claim 37, further comprising scanning means for scanning said recording head.

57. A recording apparatus according to claim 37, further comprising carriage means for carrying said recording head.

58. A recording method for recording on a recording medium using a recording head provided with a plurality of recording elements, on the basis of recording data inputted from a host computer, said method comprising the steps of:

scanning reciprocatingly the recording head for recording;

storing the inputted recording data;

transferring to the recording head drive data based upon the recording data stored in the storing step, via a plurality of data lines, wherein a resolution of the drive data is higher than that of the recording data;

driving said recording head according to the drive data transferred in the transferring step; and counting the drive data transferred over a part of, but not all of, the plurality of data lines in the transferring step, in the forward and backward scans of the recording head.

59. A recording method according to claim 58, wherein in the counting step, drive data for driving a half of said plurality of recording elements is counted in the forward, scan, and drive data for driving a residual half of recording elements is counted in the backward scan.

60. A recording method according to claim 59, wherein said half of said plurality of recording elements are either odd or even recording elements of said plurality of recording elements.

61. A recording method according to claim 58, wherein in the counting step, a part of the drive data is counted.

62. A recording method according to claim 61, wherein different recording elements are subjected to counting by said count means between the forward scan and the backward scan.

63. A recording method according to claim 58, wherein another recording head provided with a plurality of recording elements of the same number as that of the recording elements of said recording head is further provided, and wherein in said scanning step, said another recording head is reciprocatingly scanned together with said recording head.

64. A recording method according to claim 63, wherein in the counting step, drive data for driving a half of said plurality of recording elements of said recording head is counted in said forward scan; and wherein in the counting step, drive data for driving a half of said plurality of recording elements of said another recording head is counted in said backward scan.

65. A recording method according to claim 58, wherein in the transferring step, drive data is serially transferred to said recording head.

66. A recording method according to claim 58, wherein in the transferring step, drive data is transferred to said recording head in parallel.

67. A recording apparatus for recording on a recording medium using a recording head provided with a plurality of recording elements, comprising:

a memory for storing input recording data;

transfer means, coupled to said memory, for transferring to the recording head drive data based upon the input recording data stored in said memory, via a plurality of data lines;

drive means, coupled to said transfer means, for driving the recording head according to the drive data transferred by said transfer means; and count means provided for the recording head and connected to a portion of said plurality of data lines, for counting the drive data transferred by said transfer means over the portion of, but not all of, the plurality of data lines.

68. Apparatus according to claim 67, wherein said transfer means transfers the drive data to the recording head via two data lines.

69. Apparatus according to claim 68, wherein said transfer means transfers the drive data to odd or even recording elements of the recording head via each of the two data lines.

70. An apparatus according to claim 67, wherein the portion of the plurality of data lines is one of the plurality of data lines.

71. A recording method for recording on a recording medium using a recording head provided with a plurality of recording elements, comprising the steps of:

storing input recording data;

transferring to the recording head drive data based upon the input recording data stored in the storing step, via a plurality of data lines;

driving the recording head according to the drive data transferred in the transferring step; and counting in response to the recording head the drive data transferred in the transferring step via a portion of, but not all of, said plurality of data lines.

72. A method according to claim 71, wherein the transferring step transfers the drive data to the recording head via two data lines.

73. A method according to claim 72, wherein the transferring step transfers the drive data to odd or even recording elements of the recording head via each of the two data lines.

74. An apparatus according to claim 71, wherein the portion of the plurality of data lines is one of the plurality of data lines.

75. A recording apparatus for recording on a recording medium using a recording head provided with a plurality of recording elements, comprising:

scanning means for reciprocatingly scanning the recording head for recording;

a memory for storing input recording data;

transfer means, coupled to said memory, for transferring to said recording head drive data based upon recording data stored in said memory, via a plurality of data lines;

drive means, coupled to said transfer means, for driving said recording head according to the drive data transferred by said transfer means; and count means provided for the recording head and connected in common to the plurality of data lines, for counting a part of, but not all of, the drive data transferred by said transfer means via the plurality of data lines, said count means alternatively counting the drive data in forward and backward scans of the recording head.

76. Apparatus according to claim 75, wherein said transfer means transfers the drive data to said recording head via two data lines.

77. Apparatus according to claim 76, wherein said count means counts drive data for driving one half of said plurality of recording elements of the recording head in the forward scan, and counts drive data for driving the remaining half of the recording elements of the recording head in the backward scan.

78. Apparatus according to claim 77, wherein said one half of said plurality of recording elements comprises either odd or even recording elements.

79. A recording method for recording on a recording medium using a recording head provided with a plurality of recording elements, comprising the steps of:

reciprocatingly scanning the recording head for recording;

storing input recording data;

transferring to the recording head drive data based upon the input recording data stored in the storing step, via a plurality of data lines;

driving the recording head according to the drive data transferred in the transferring step; and counting in response to the recording head a part of, but not all of, the drive data transferred in the transferring step via the plurality of data lines, the counting being alternately performed in the forward and backward scans of the recording head.

80. A method according to claim 79, wherein the transferring step transfers the drive data to the recording head via two data lines.

81. A method according to claim 80, wherein the counting step counts drive data for driving one half of the plurality of recording elements of the recorded head in the forward scan, and counts drive data for driving the remaining half of the recording elements of the recording head in the backwards scan.

82. A method according to claim 81, wherein said one half of the recording elements are either odd or even recording elements.

83. A recording apparatus for recording on a recording medium using a plurality of recording heads, each of the recording heads being provided with a plurality of recording elements, comprising:

a memory for storing input recording data;

transfer means, coupled to said memory, for transferring to each of the recording heads drive data based upon the recording data stored in said memory, via a plurality of data lines;

drive means, coupled to said transfer means, for driving each of the recording heads according to the drive data transferred by said transfer means; and counting means for counting a part of, but not all of, the drive data transferred over the plurality of data lines to each of the recording heads by said transfer means.

84. A recording method for recording on a recording medium using a plurality of recording heads, each of the recording heads being provided with a plurality of recording elements, comprising the steps of:

storing input recording data;

transferring to each of the recording head drive data based upon the recording data stored in the recording step, via a plurality of data lines;

driving each of the recording heads according to the drive data transferred in the transferring step; and counting a part of, but not all of, the drive data transferred over the plurality of data lines to each of the recording heads in the transferring step.

* * * * *

UNITED STATES PATENT AND TRADEMARK OFFICE

CERTIFICATE OF CORRECTION

PATENT NO. : 6,123,404

DATED : September 26, 2000

INVENTOR(S) : TANAKA, ET AL.

It is certified that error appears in the above-identified patent and that said Letters Patent is hereby corrected as shown below:

[56] References Cited:
FOREIGN PATENT DOCUMENTS, "519467" should read --5-19467--, and "3031352" should read --3-31352--.

COLUMN 1:
Line 58, "speed" should read --speed,--.

COLUMN 4:
Line 44, "engaged" should read --engaged by--.

COLUMN 10:
Line 7, "counter" should read --counters--.

COLUMN 13:
Line 36, "connected" should read --connect--.

COLUMN 17:
Line 50, "(1)" should read --(i)--.
Line 51, "(11)" should read --(ii)--.
Line 65, "where in" should read --wherein--.

COLUMN 20:
Line 16, "recording elements are" should read --said plurality of recording elements are either--.
Line 36, "head" should read --apparatus--.

UNITED STATES PATENT AND TRADEMARK OFFICE

CERTIFICATE OF CORRECTION

PATENT NO. : 6,123,404

DATED : September 26, 2000

INVENTOR(S) : TANAKA, ET AL.

It is certified that error appears in the above-identified patent and that said Letters Patent is hereby corrected as shown below:

COLUMN 22:

Line 45, "An apparatus" should read --A method--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*